US009158248B2

(12) United States Patent
Arai et al.

(10) Patent No.: US 9,158,248 B2
(45) Date of Patent: Oct. 13, 2015

(54) FIXING DEVICE AND IMAGE FORMING APPARATUS

(71) Applicants: Yuji Arai, Kanagawa (JP); Masaaki Yoshikawa, Tokyo (JP); Takayuki Seki, Kanagawa (JP); Takeshi Yamamoto, Kanagawa (JP); Ryuuichi Mimbu, Kanagawa (JP); Yutaka Ikebuchi, Kanagawa (JP); Takuya Seshita, Kanagawa (JP); Shuntaro Tamaki, Kanagawa (JP); Hajime Gotoh, Kanagawa (JP); Takahiro Imada, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP); Hiroshi Yoshinaga, Chiba (JP)

(72) Inventors: Yuji Arai, Kanagawa (JP); Masaaki Yoshikawa, Tokyo (JP); Takayuki Seki, Kanagawa (JP); Takeshi Yamamoto, Kanagawa (JP); Ryuuichi Mimbu, Kanagawa (JP); Yutaka Ikebuchi, Kanagawa (JP); Takuya Seshita, Kanagawa (JP); Shuntaro Tamaki, Kanagawa (JP); Hajime Gotoh, Kanagawa (JP); Takahiro Imada, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP); Hiroshi Yoshinaga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/267,169

(22) Filed: May 1, 2014

(65) Prior Publication Data

US 2014/0341624 A1 Nov. 20, 2014

(30) Foreign Application Priority Data

May 14, 2013 (JP) ..... 2013-102184

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 13/08; G03G 13/16; G03G 13/20; G03G 9/0819; G03G 9/09783; G03G 15/2053; G03G 9/08746; G03G 9/08766
See application file for complete search history.

(56) References Cited

U.S. PATENT DOCUMENTS

| | | | | |
|---|---|---|---|---|
| 8,351,807 | B2 * | 1/2013 | Seki | 399/45 |
| 2011/0116822 | A1 * | 5/2011 | Takenaka et al. | 399/69 |
| 2013/0209147 | A1 | 8/2013 | Ogawa et al. | |
| 2014/0072355 | A1 | 3/2014 | Tamaki et al. | |
| 2014/0079453 | A1 | 3/2014 | Arai et al. | |

FOREIGN PATENT DOCUMENTS

| | | |
|---|---|---|
| JP | 2013-164473 | 8/2013 |
| JP | 2014-056203 | 3/2014 |
| JP | 2014-059335 | 4/2014 |

* cited by examiner

*Primary Examiner* — Roy Y Yi
(74) *Attorney, Agent, or Firm* — Oblon, McClelland, Maier & Neustadt, L.L.P.

(57) ABSTRACT

A fixing device includes a fixing rotary body and a heater disposed opposite and heating the fixing rotary body. A nip formation assembly presses against an opposed body via the fixing rotary body to form a fixing nip between the fixing rotary body and the opposed body, through which a recording medium is conveyed. A movable heat shield movable in a circumferential direction of the fixing rotary body is interposed between the heater and the fixing rotary body to shield the fixing rotary body from the heater in a variable axial span of the fixing rotary body. A stationary heat shield, interposed between the heater and the fixing rotary body to shield the fixing rotary body from the heater, is disposed outboard from a lateral edge of a heat generator of the heater in an axial direction of the fixing rotary body.

17 Claims, 18 Drawing Sheets

| RECORDING MEDIUM SIZE \ CROSS-SECTION | I (BRIDGE) | II (INBOARD SHIELD PORTION) | III (OUTBOARD SHIELD PORTION) |
|---|---|---|---|
| SMALL (A5, POSTCARD) |  |  |  |
| MEDIUM/ LARGE (A3, A4) |  |  |  |
| EXTRA-LARGE (A3 EXTENSION) |  |  |  |

FIG. 18

| RECORDING MEDIUM | CENTER HEATER | | LATERAL END HEATER | | RECORDING MEDIUM SIZE |
|---|---|---|---|---|---|
| | ON | SHIELDING | ON | SHIELDING | |
| A | YES | NO | YES | NO | A3 EXTENSION |
| B | YES | NO | YES | YES | A3, A4 LANDSCAPE |
| C | YES | NO | NO | YES OR NO | A4 PORTRAIT |
| D | YES | YES | NO | YES OR NO | A5, POSTCARD |

: EACH AXIAL END OF FIXING BELT OVERHEATS SIGNIFICANTLY

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2013-102184, filed on May 14, 2013, in the Japanese Patent Office, the entire disclosure of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

The fixing device may employ an endless belt or an endless film to heat the recording medium. For example, as disclosed by JP-2004-286922-A, the fixing device includes the endless belt looped over a heating roller and a nip formation pad and a pressure roller pressed against the nip formation pad via the belt to form a fixing nip between the pressure roller and the belt. As the recording medium bearing the toner image is conveyed through the fixing nip, the belt and the pressure roller apply heat and pressure to the recording medium, melting and fixing the toner image on the recording medium.

The belt is requested to be heated quickly to shorten a first print time taken to output the recording medium bearing the fixed toner image upon receipt of a print job. Additionally, as the image forming apparatus conveys an increased amount of recording media at high speed, the belt is requested to overcome shortage of heat.

To address those requests, the fixing device may include the endless film. For example, as disclosed by JP-H4-044083-P, a pressure roller is pressed against a heater disposed inside a loop formed by the film via the film to form a fixing nip between the pressure roller and the film. As the recording medium bearing the toner image is conveyed through the fixing nip, the film and the pressure roller apply heat and pressure to the recording medium, melting and fixing the toner image on the recording medium. Since the film is heated by the heater situated at the fixing nip, the film is heated insufficiently at an entry to the fixing nip, resulting in faulty fixing. Accordingly, the film is requested to overcome shortage of heat at the entry to the fixing nip.

To address those requests, the fixing device may employ a metal thermal conductor as disclosed by JP-2007-334205-P. FIG. 1 illustrates a fixing device 20R disclosed by JP-2007-334205-P. A tubular, metal thermal conductor 302R is disposed inside an endless belt 301R. The endless belt 301R is slidable over the metal thermal conductor 302R. A heater 303R is located inside the metal thermal conductor 302R. The heater 303R heats the metal thermal conductor 302R which in turn heats the endless belt 301R. A pressure roller 304R is pressed against the metal thermal conductor 302R via the endless belt 301R to form a fixing nip N between the pressure roller 304 and the endless belt 301R. As the pressure roller 304R rotates clockwise in FIG. 1, the endless belt 301R rotates counterclockwise in FIG. 1 in accordance with rotation of the pressure roller 304R, thus conveying a recording medium P bearing a toner image in a recording medium conveyance direction D1. Since the tubular, metal thermal conductor 302R is disposed opposite the endless belt 301R throughout the entire circumferential span of the endless belt 301R, the metal thermal conductor 302R heats the endless belt 301R quickly, thus shortening the first print time and overcoming shortage of heat.

In order to shorten the first print time further, the fixing device may employ an endless belt directly heated by a heater disposed inside or outside the endless belt as disclosed by JP-2008-058833-A and JP2008-139779-A. However, since a recording medium is not conveyed over the endless belt at both axial ends of the endless belt and therefore does not draw heat from both axial ends of the endless belt, both axial ends of the endless belt are susceptible to overheating. To address this circumstance, a heat shield may be interposed between the heater and the endless belt to shield the endless belt from the heater.

However, as the heat shield is heated by the heater, the heat shield and a resin flange situated in proximity to the heat shield are susceptible to overheating that may result in thermal deformation of the heat shield and the flange.

SUMMARY

This specification describes below an improved fixing device. In one exemplary embodiment, the fixing device includes a fixing rotary body rotatable in a predetermined direction of rotation and a heater disposed opposite and heating the fixing rotary body. The heater includes a heat generator to generate heat. An opposed body contacts the fixing rotary body. A nip formation assembly presses against the opposed body via the fixing rotary body to form a fixing nip between the fixing rotary body and the opposed body, through which a recording medium is conveyed. A movable heat shield movable in a circumferential direction of the fixing rotary body is interposed between the heater and the fixing rotary body to shield the fixing rotary body from the heater in a variable axial span of the fixing rotary body. A stationary heat shield, interposed between the heater and the fixing rotary body to shield the fixing rotary body from the heater, is disposed outboard from a lateral edge of the heat generator of the heater in an axial direction of the fixing rotary body.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein:

FIG. 18 is a lookup table showing a relation between the size of a recording medium conveyed over the fixing belt, turning on of a center heater and a lateral end heater incorporated in the fixing device shown in FIG. 16, and shielding of the movable heat shield;

DETAILED DESCRIPTION OF THE INVENTION

Figure 1:
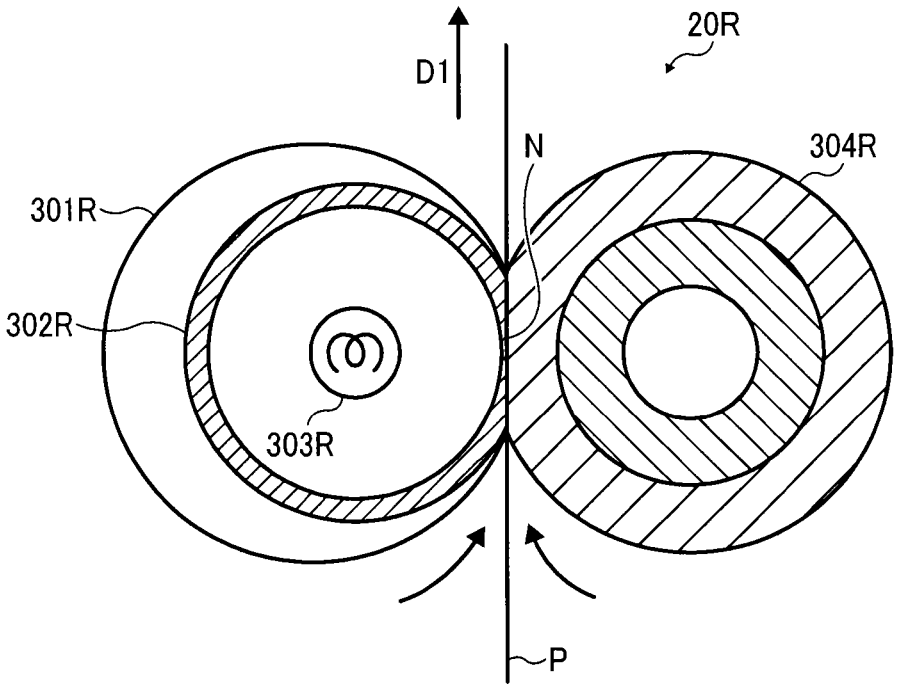
FIG. 1 RELATED ART
FIG. 1 is a vertical sectional view of a related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 2:
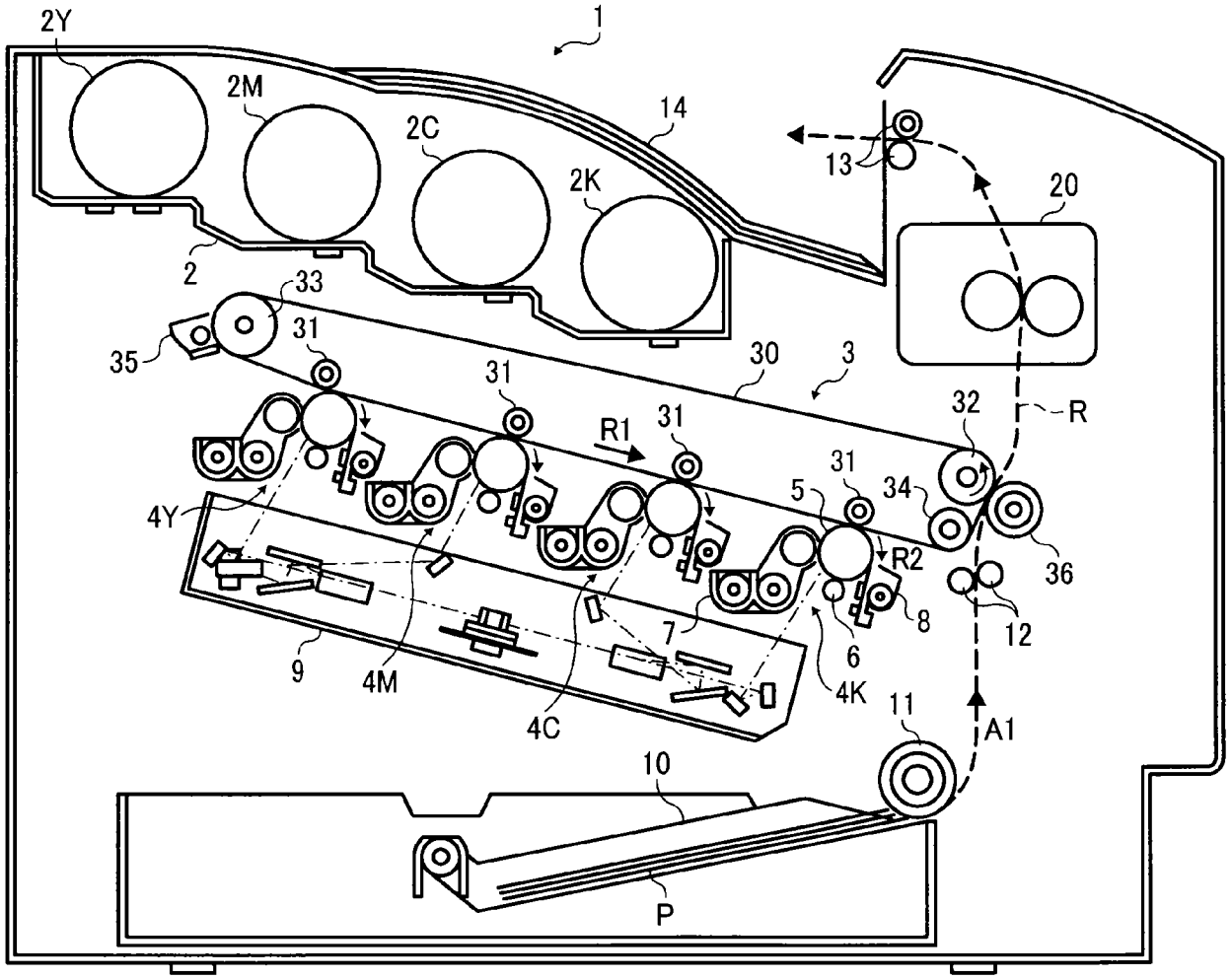
FIG. 2 is a schematic vertical sectional view of an image forming apparatus according to an exemplary embodiment of the present invention.

Referring now to the drawings, wherein like reference numerals designate identical or corresponding parts throughout the several views, in particular to FIG. 2, an image forming apparatus 1 according to an exemplary embodiment of the present invention is explained.

FIG. 2 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

As shown in FIG. 2, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 2, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 2, the secondary transfer backup roller 32 rotates the intermediate transfer belt 30 counterclockwise in FIG. 2 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, overhead projector (OHP) transparencies, and the like. Additionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 serving as a timing roller pair feeds the recording medium P conveyed from the feed roller 11 toward the secondary transfer nip at a proper time.

The conveyance path R is further provided with a fixing device 20 located above the secondary transfer nip, that is, downstream from the secondary transfer nip in the recording medium conveyance direction A1. The fixing device 20 fixes a toner image transferred from the intermediate transfer belt 30 onto the recording medium P conveyed from the secondary transfer nip. The conveyance path R is further provided with the output roller pair 13 located above the fixing device 20, that is, downstream from the fixing device 20 in the recording medium conveyance direction A1. The output roller pair 13 discharges the recording medium P bearing the fixed toner image onto the outside of the image forming apparatus 1, that is, an output tray 14 disposed atop the image forming apparatus 1. The output tray 14 stocks the recording medium P discharged by the output roller pair 13.

With reference to FIG. 2, a description is provided of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, clockwise in FIG. 2 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 2, rotating the intermediate transfer belt 30 in the rotation direction R1 by friction therebetween. The power supply applies a constant voltage or a constant current control voltage having a polarity opposite a polarity of the charged toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. As the recording medium P comes into contact with the registration roller pair 12, the registration roller pair 12 that interrupts its rotation temporarily halts the recording medium P.

Thereafter, the registration roller pair 12 resumes its rotation and conveys the recording medium P to the secondary transfer nip at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip. The transfer electric field secondarily transfers the yellow, magenta, cyan, and black toner images constituting the color toner image formed on the intermediate transfer belt 30 onto the recording medium P collectively. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the outside of the image forming apparatus 1, that is, the output tray 14 that stocks the recording medium P.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 3:
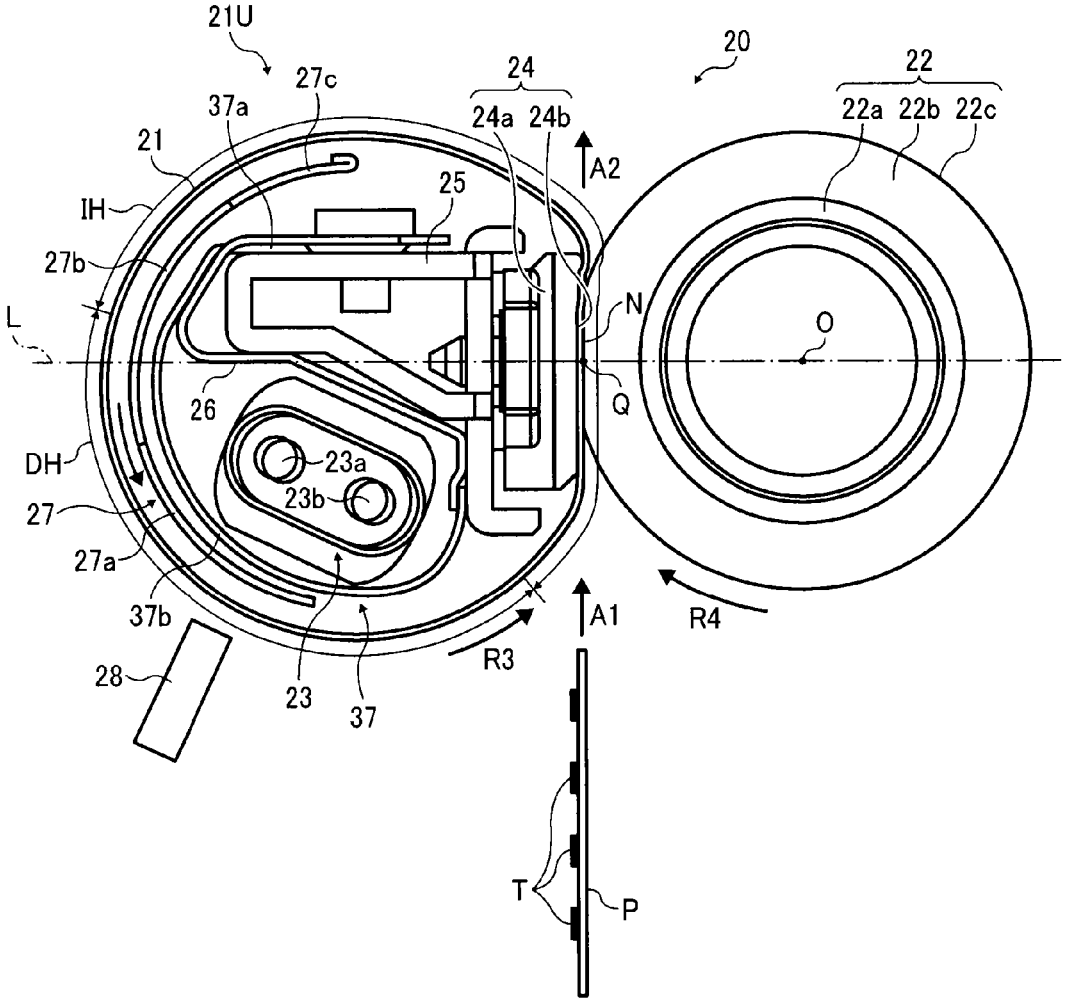
FIG. 3 is a vertical sectional view of a fixing device incorporated in the image forming apparatus shown in FIG. 2 illustrating a movable heat shield incorporated therein that is situated at a shield position.
Figure 4:
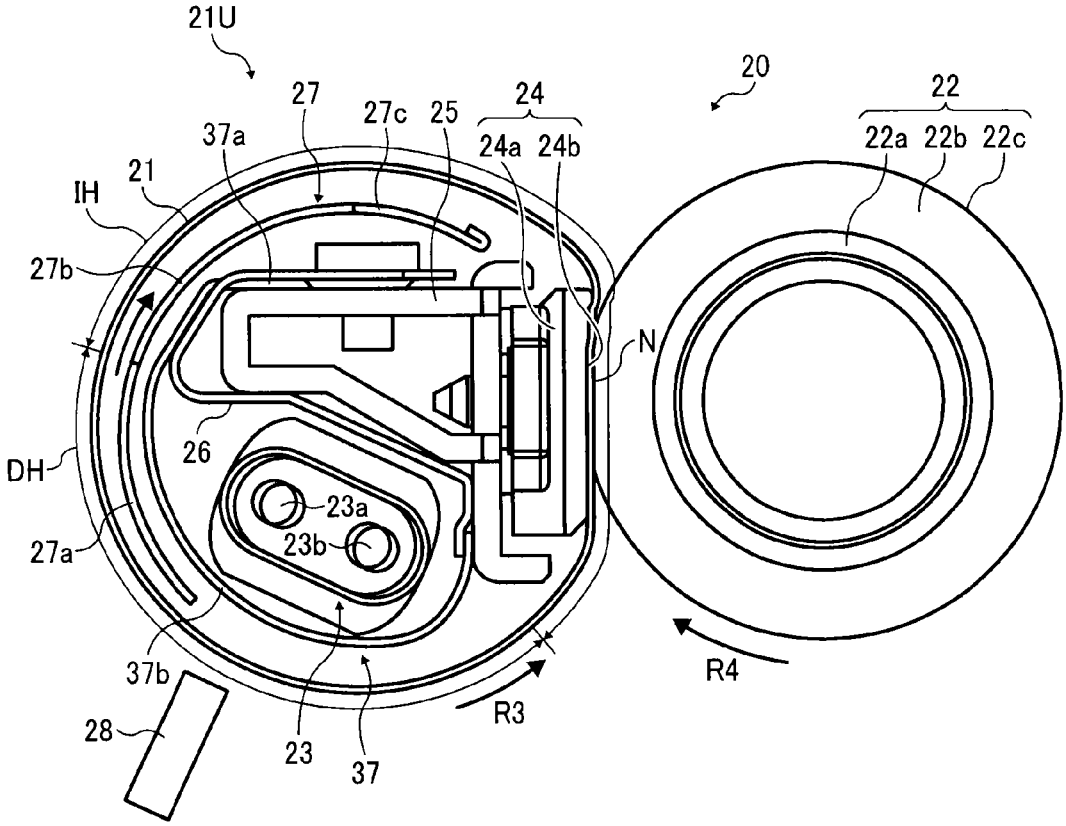
FIG. 4 is a vertical sectional view of the fixing device shown in FIG. 3 illustrating the movable heat shield situated at a retracted position.

With reference to FIGS. 3 and 4, a description is provided of a construction of the fixing device 20 incorporated in the image forming apparatus 1 described above.

FIG. 3 is a vertical sectional view of the fixing device 20 illustrating a movable heat shield 27 incorporated therein that is situated at a shield position. FIG. 4 is a vertical sectional view of the fixing device 20 illustrating the movable heat shield 27 situated at a retracted position.

As shown in FIG. 3, the fixing device 20 (e.g., a fuser) includes a fixing belt 21 serving as a fixing rotary body or an endless belt formed into a loop and rotatable in a rotation direction R3 and a pressure roller 22 serving as an opposed body disposed opposite an outer circumferential surface of the fixing belt 21 to separably or inseparably contact the fixing belt 21 and rotatable in a rotation direction R4 counter to the rotation direction R3 of the fixing belt 21. The fixing device 20 further includes a halogen heater pair 23, a nip formation assembly 24, a stay 25, a reflector 26, the movable heat shield 27, a stationary heat shield 37, and a temperature sensor 28. The halogen heater pair 23 serves as a heater disposed inside the loop formed by the fixing belt 21 and heating the fixing belt 21. The nip formation assembly 24 is disposed inside the loop formed by the fixing belt 21 and presses against the pressure roller 22 via the fixing belt 21 to form a fixing nip N between the fixing belt 21 and the pressure roller 22. The stay 25 serves as a support disposed inside the loop formed by the fixing belt 21 and contacting and supporting the nip formation assembly 24. The reflector 26 is disposed inside the loop formed by the fixing belt 21 and reflects light radiated from the halogen heater pair 23 toward the fixing belt 21. The movable heat shield 27 and the stationary heat shield 37 are interposed between the halogen heater pair 23 and the fixing belt 21 to shield the fixing belt 21 from light radiated from the halogen heater pair 23. The temperature sensor 28 serves as a temperature detector disposed opposite the outer circumferential surface of the fixing belt 21 and detecting the temperature of the fixing belt 21. The fixing belt 21 and the components disposed inside the loop formed by the fixing belt 21, that is, the halogen heater pair 23, the nip formation assembly 24, the stay 25, the reflector 26, the movable heat shield 27, and the stationary heat shield 37, may constitute a belt unit 21U separably coupled with the pressure roller 22.

The stationary heat shield 37 is interposed between each lateral end of the reflector 26 in a longitudinal direction thereof and the movable heat shield 27. The stationary heat shield 37 includes an arcuate shield portion 37*b* disposed opposite each lateral end of the halogen heater pair 23 in a longitudinal direction thereof that faces the fixing belt 21 and extending along an inner circumferential surface of the movable heat shield 27 from an upper left of the stay 25 to a lower right of the stay 25 in FIG. 3.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing property of being heated to a predetermined fixing temperature quickly. However, as the pressure roller 22 and the fixing belt 21 sandwich and press a toner image T on a recording medium P passing through the fixing nip N, slight surface asperities of the fixing belt 21 may be transferred onto the toner image T on the recording medium P, resulting in variation in gloss of the solid toner image T. To address this problem, it is preferable that the fixing belt 21 incorporates the elastic layer having a thickness not smaller than about 80 micrometers. The elastic layer having the thickness not smaller than about 80 micrometers elastically deforms to absorb slight surface asperities of the fixing belt 21, preventing variation in gloss of the toner image T on the recording medium P.

According to this exemplary embodiment, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 80 micrometers to about 300 micrometers; and the release layer having a thickness in a range of from about 3 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm and preferably not greater than about 0.16 mm. Additionally, the loop diameter of the fixing belt 21 may not be greater than about 30 mm.

A detailed description is now given of a construction of the pressure roller 22.

The pressure roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. A pressurization assembly (e.g., a spring) presses the pressure roller 22 against the nip formation assembly 24 via the fixing belt 21. Thus, the pressure roller 22 pressingly contacting the fixing belt 21 deforms the elastic layer 22*b* of the pressure roller 22 at the fixing nip N formed between the pressure roller 22 and the fixing belt 21, thus creating the fixing nip N having a predetermined length in the recording medium conveyance direction A1.

Figure 5:
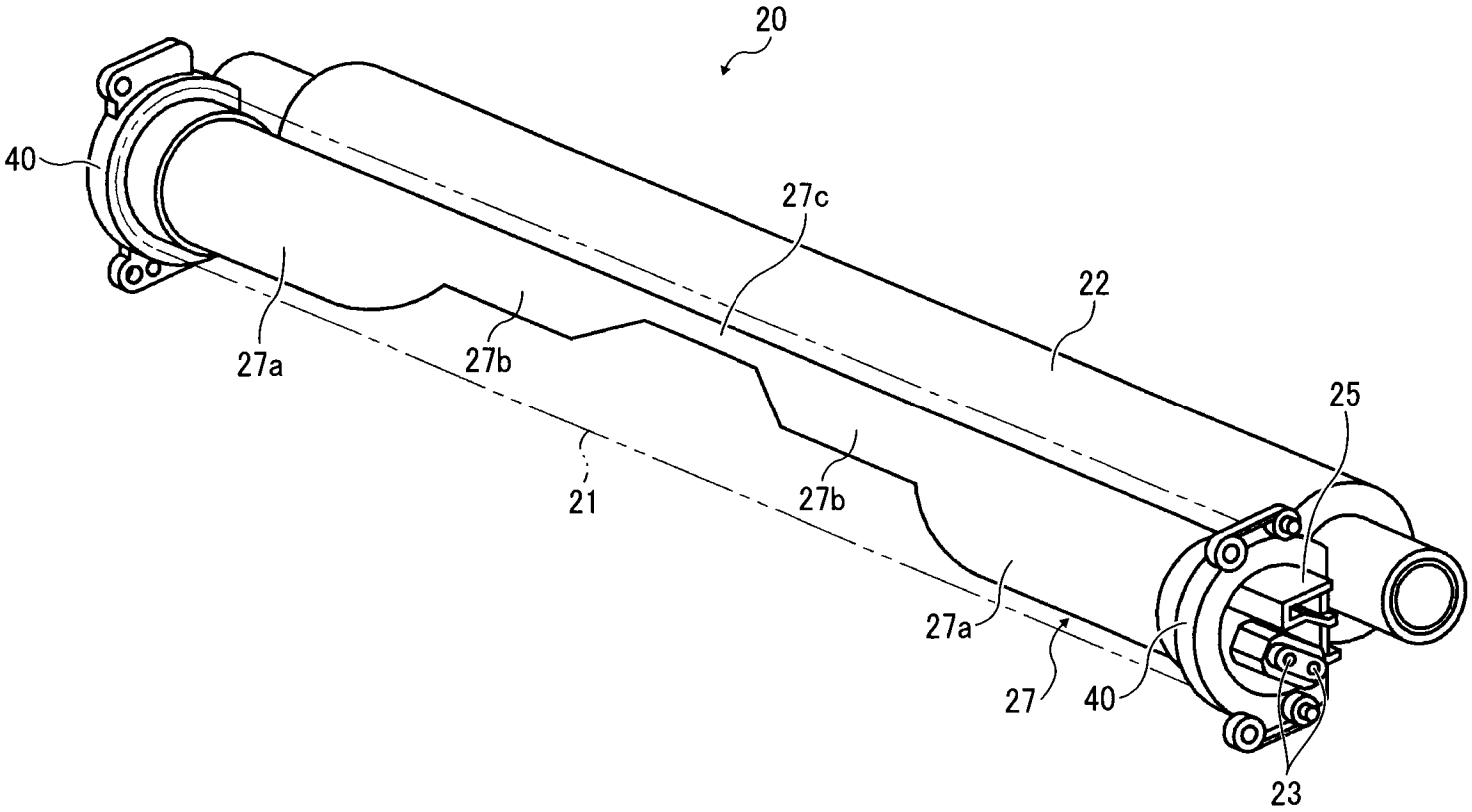
FIG. 5 is a partial perspective view of the fixing device shown in FIG. 4.

A driver (e.g., a motor) disposed inside the image forming apparatus 1 depicted in FIG. 2 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21. FIG. 5 is a partial perspective view of the fixing device 20. As shown in FIG. 5, flanges 40 serving as a belt holder are situated outboard from the fixing nip N in an axial direction of the fixing belt 21. The flanges 40 are inserted into both lateral ends of the fixing belt 21 in the axial direction thereof, respectively, to rotatably support the fixing belt 21.

As shown in FIG. 3, according to this exemplary embodiment, the pressure roller 22 is a solid roller. Alternatively, the pressure roller 22 may be a hollow roller. In this case, a heater such as a halogen heater may be disposed inside the hollow roller. The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21.

A detailed description is now given of a configuration of the halogen heater pair 23.

As shown in FIG. 3, the halogen heater pair 23 is situated inside the loop formed by the fixing belt 21 and upstream from the fixing nip N in the recording medium conveyance direction A1. For example, the halogen heater pair 23 is situated lower than and upstream from a hypothetical line L passing through a center Q of the fixing nip N in the recording medium conveyance direction A1 and an axis O of the pressure roller 22 in FIG. 3.

The power supply situated inside the image forming apparatus 1 supplies power to the halogen heater pair 23 so that the halogen heater pair 23 heats the fixing belt 21. A controller (e.g., a processor), that is, a central processing unit (CPU) provided with a random-access memory (RAM) and a read-only memory (ROM), for example, operatively connected to the halogen heater pair 23 and the temperature sensor 28 controls the halogen heater pair 23 based on the temperature of the outer circumferential surface of the fixing belt 21 detected by the temperature sensor 28 so as to adjust the temperature of the fixing belt 21 to a desired fixing temperature. Alternatively, the controller may be operatively connected to a temperature sensor disposed opposite the pressure roller 22 to detect the temperature of the pressure roller 22 so that the controller predicts the temperature of the fixing belt 21 based on the temperature of the pressure roller 22 detected by the temperature sensor, thus controlling the halogen heater pair 23.

According to this exemplary embodiment, two halogen heaters constituting the halogen heater pair 23 are situated inside the loop formed by the fixing belt 21. Alternatively, one halogen heater or three or more halogen heaters may be situated inside the loop formed by the fixing belt 21 according to a plurality of sizes of the recording media P available in the image forming apparatus 1. However, it is preferable to locate two or less halogen heaters inside the loop formed by the fixing belt 21 to reduce manufacturing costs of the halogen heaters and downsize a space inside the loop formed by the fixing belt 21. Alternatively, instead of the halogen heater pair 23, an induction heater, a resistance heat generator, a carbon heater, or the like may be employed as a heater that heats the fixing belt 21.

A detailed description is now given of a construction of the nip formation assembly 24.

The nip formation assembly 24 includes a base pad 24*a* and a slide sheet 24*b* (e.g., a low-friction sheet) covering an outer surface of the base pad 24*a*. For example, the slide sheet 24*b* covers an opposed face of the base pad 24*a* disposed opposite the fixing belt 21. A longitudinal direction of the base pad 24*a* is parallel to the axial direction of the fixing belt 21 or the pressure roller 22. The base pad 24*a* receives pressure from the pressure roller 22 to define the shape of the fixing nip N. According to this exemplary embodiment, the fixing nip N is planar in cross-section as shown in FIG. 3. Alternatively, the fixing nip N may be concave with respect to the pressure roller 22 or have other shapes. The slide sheet 24*b* reduces friction between the base pad 24*a* and the fixing belt 21 sliding thereover as the fixing belt 21 rotates in the rotation direction R3. Alternatively, the base pad 24*a* may be made of a low friction material. In this case, the slide sheet 24*b* is not interposed between the base pad 24*a* and the fixing belt 21.

The base pad 24*a* is made of a heat resistant material resistant against temperatures of 200 degrees centigrade or higher to prevent thermal deformation of the nip formation assembly 24 by temperatures in a fixing temperature range desirable to fix the toner image T on the recording medium P, thus retaining the shape of the fixing nip N and quality of the toner image T formed on the recording medium P. For example, the base pad 24*a* is made of general heat resistant resin such as polyether sulfone (PES), polyphenylene sulfide (PPS), liquid crystal polymer (LCP), polyether nitrile (PEN), polyamide imide (PAI), polyether ether ketone (PEEK), or the like.

The base pad 24*a* is mounted on and supported by the stay 25. Accordingly, even if the base pad 24*a* receives pressure from the pressure roller 22, the base pad 24*a* is not bent by the pressure and therefore produces a uniform nip width throughout the entire width of the pressure roller 22 in the axial direction thereof. The stay 25 is made of metal having an increased mechanical strength, such as stainless steel and iron, to prevent bending of the nip formation assembly 24. The base pad 24*a* is also made of a rigid material having an increased mechanical strength. For example, the base pad 24*a* is made of resin such as LCP, metal, ceramic, or the like.

A detailed description is now given of a construction of the reflector 26.

The reflector 26 is mounted on and supported by the stay 25 and disposed opposite the halogen heater pair 23. The reflector 26 reflects light or heat radiated from the halogen heater pair 23 thereto onto the fixing belt 21, suppressing conduction of heat from the halogen heater pair 23 to the stay 25 or the like. Thus, the reflector 26 facilitates efficient heating of the fixing belt 21, saving energy. The reflector 26 is secured to the stay 25 at a single place, for example, at a center of the reflector 26 in a longitudinal direction thereof to allow both lateral ends of the reflector 26 in the longitudinal direction thereof to expand and contract by thermal expansion evenly. Each lateral end of the reflector 26 in the longitudinal direction thereof is produced with an elongate hole through which a screw fastens the reflector 26 to the stay 25 loosely to allow expansion and contraction of the reflector 26.

For example, the reflector 26 is made of aluminum, stainless steel, or the like. If the reflector 26 includes an aluminum base treated with silver-vapor-deposition to decrease radiation and increase reflectance of light, the reflector 26 heats the fixing belt 21 effectively. An opposed face of the reflector 26 that is disposed opposite the halogen heater pair 23 expands over the inner circumferential surface of the fixing belt 21.

A detailed description is now given of a configuration of the stationary heat shield 37.

The stationary heat shield 37 disposed opposite a lower face of the halogen heater pair 23 extends along a circumferential direction of the fixing belt 21 to shield both lateral ends of the fixing belt 21 in the axial direction thereof from the halogen heater pair 23. The stationary heat shield 37 does not span the entire width of the reflector 26 in the longitudinal direction thereof.

A detailed description is now given of a configuration of the movable heat shield 27.

The movable heat shield 27 is a heat resistant metal plate, made of SUS stainless steel or the like and having a thickness in a range of from about 0.1 mm to about 1.0 mm, that is curved in the circumferential direction of the fixing belt 21 along the inner circumferential surface thereof. As shown in FIG. 3, the movable heat shield 27 is not a tube that is endless in cross-section in the circumferential direction of the fixing belt 21 but an arch having both terminals in the circumferential direction of the fixing belt 21. For example, the movable heat shield 27 is partially an arch in cross-section.

The movable heat shield 27 is rotatable around the halogen heater pair 23. According to this exemplary embodiment, the movable heat shield 27 is rotatable in the circumferential direction of the fixing belt 21. For example, as shown in FIG. 4, a circumference of the fixing belt 21 is divided into two sections: a circumferential, direct heating span DH where the halogen heater pair 23 is disposed opposite and heats the fixing belt 21 directly and a circumferential, indirect heating span IH where the halogen heater pair 23 is disposed opposite the fixing belt 21 indirectly via the components other than the movable heat shield 27, that is, the reflector 26, the stay 25, the nip formation assembly 24, and the like.

The movable heat shield 27 moves to the shield position shown in FIG. 3 where the movable heat shield 27 is disposed opposite the halogen heater pair 23 directly in the direct heating span DH to shield the fixing belt 21 from the halogen heater pair 23. Conversely, the movable heat shield 27 moves to the retracted position shown in FIG. 4 where the movable heat shield 27 is disposed opposite the halogen heater pair 23 indirectly in the indirect heating span IH to allow the halogen heater pair 23 to heat the fixing belt 21 directly. At the retracted position shown in FIG. 4, the movable heat shield 27 is behind the reflector 26 and the stay 25. The movable heat shield 27 is made of a heat resistant material, for example, metal such as aluminum, iron, and stainless steel or ceramic.

With reference to FIG. 5, a detailed description is now given of a configuration of the flanges 40.

As shown in FIG. 5, the flanges 40 serving as a belt holder are inserted into both lateral ends of the fixing belt 21 in the axial direction thereof, respectively, to rotatably support the fixing belt 21. The flanges 40, the halogen heater pair 23, and the stay 25 are mounted on and supported by a pair of side plates described below of the fixing device 20.

Figure 6:
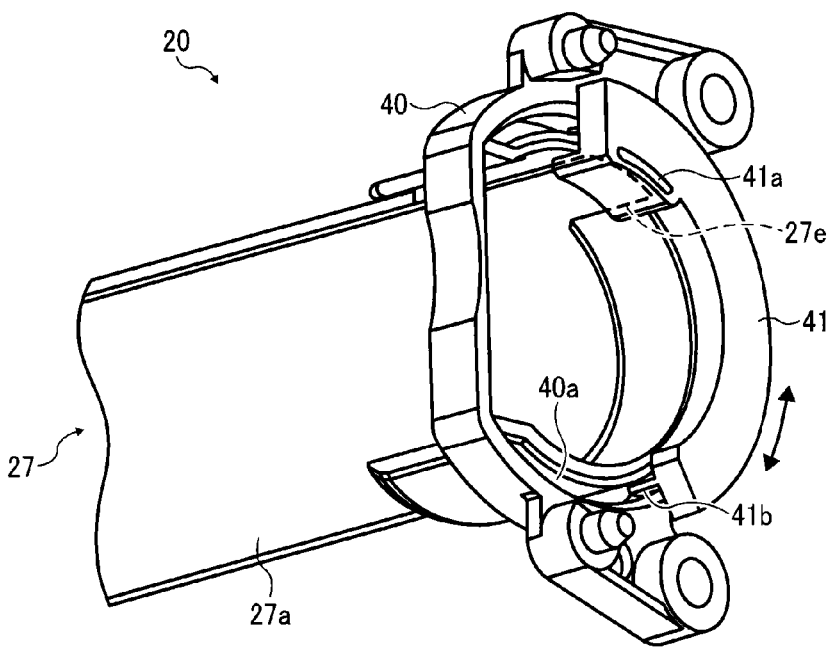
FIG. 6 is a partial perspective view of the fixing device shown in FIG. 3 illustrating one lateral end of the movable heat shield in an axial direction thereof.

With reference to FIG. 6, a description is provided of a construction of a support mechanism that supports the movable heat shield 27.

FIG. 6 is a partial perspective view of the fixing device 20 illustrating one lateral end of the movable heat shield 27 in the axial direction of the fixing belt 21. As shown in FIG. 6, the movable heat shield 27 is supported by an arcuate slider 41 rotatably or slidably attached to the flange 40. For example, a projection 27*e* serving as a support disposed at each lateral end of the movable heat shield 27 in the axial direction of the fixing belt 21 is inserted into a hole 41*a* produced in the slider 41. Thus, the movable heat shield 27 is attached to the slider 41.

The slider 41 includes a tab 41*b* projecting inboard in the axial direction of the fixing belt 21 toward the movable heat shield 27. As the tab 41*b* of the slider 41 is inserted into an arcuate groove 40*a* produced in the flange 40, the slider 41 is slidably movable in the groove 40*a*. Accordingly, the movable heat shield 27, together with the slider 41, is rotatable or movable in a circumferential direction of the flange 40. The flange 40 and the slider 41 are made of resin.

Although FIG. 6 illustrates the support mechanism that supports the movable heat shield 27 at one lateral end thereof in the axial direction of the fixing belt 21, another lateral end of the movable heat shield 27 in the axial direction of the fixing belt 21 is also supported by the support mechanism shown in FIG. 6. Thus, another lateral end of the movable heat shield 27 is also rotatably or movably supported by the slider 41 slidable in the groove 40*a* of the flange 40.

Figure 7:
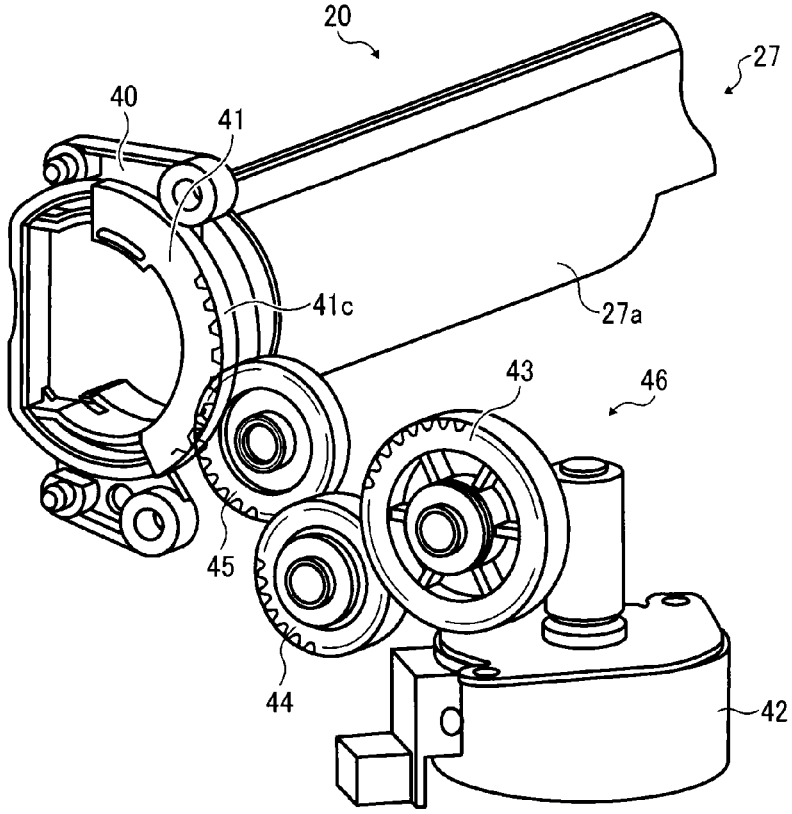
FIG. 7 is a partial perspective view of the fixing device shown in FIG. 3 illustrating a driver incorporated therein.

With reference to FIG. 7, a description is provided of a construction of a driver 46 that drives and rotates the movable heat shield 27.

FIG. 7 is a partial perspective view of the fixing device 20 illustrating the driver 46. As shown in FIG. 7, the driver 46 includes a motor 42 serving as a driving source and a plurality of gears 43, 44, and 45 constituting a gear train. The gear 43 serving as one end of the gear train is connected to the motor 42. The gear 45 serving as another end of the gear train is connected to a gear 41*c* produced on the slider 41 along a circumferential direction thereof. Accordingly, as the motor 42 is driven, a driving force is transmitted from the motor 42 to the gear 41*c* of the slider 41 through the gear train, that is, the gears 43 to 45, thus rotating the movable heat shield 27 supported by the slider 41.

With reference to FIGS. 8 to 16, a description is provided of a construction of comparative fixing devices 20C1, 20C2, and 20C3 that do not incorporate the movable heat shield 27 and the stationary heat shield 37 depicted in FIGS. 3 and 4.

Figure 8:
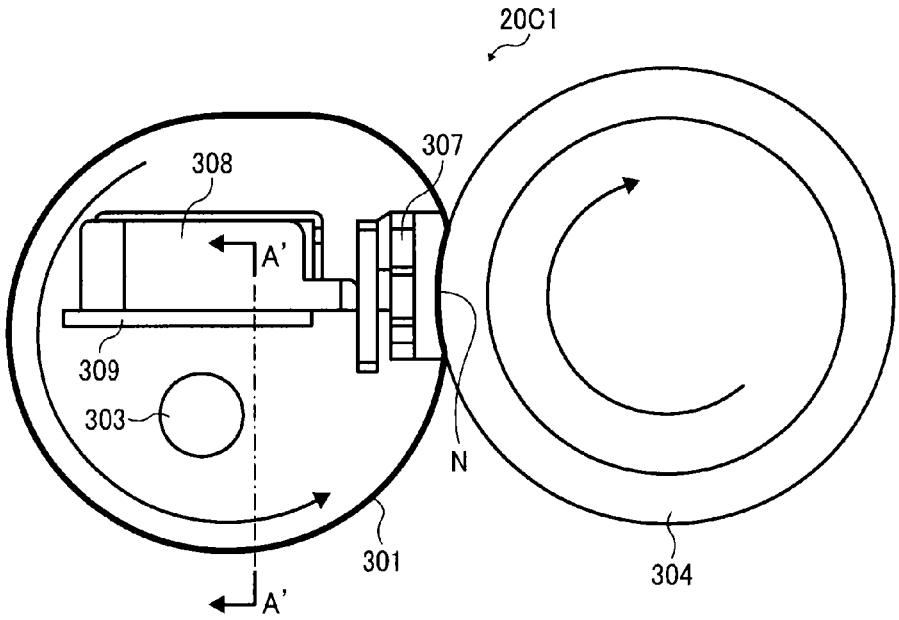
FIG. 8 is a vertical sectional view of a comparative fixing device.

FIG. 8 is a vertical sectional view of the comparative fixing device 20C1. As shown in FIG. 8, the comparative fixing device 20C1 includes a fixing belt 301; a heater 303 that heats the fixing belt 301 directly; a nip formation assembly 307 disposed inside the fixing belt 301; and a pressure roller 304 pressed against the nip formation assembly 307 via the fixing belt 301 to form a fixing nip N between the pressure roller 304 and the fixing belt 301.

The comparative fixing device 20C1 further includes a stay 308 serving as a support that supports the nip formation assembly 307 and a reflector 309 mounted on a lower face of the stay 308. Since the heater 303 heats the fixing belt 301 directly, heat is conducted from the heater 303 to the fixing belt 301 effectively, reducing power consumption and shortening a first print time taken to output a recording medium bearing a fixed toner image upon receipt of a print job at reduced manufacturing costs.

Figure 9:
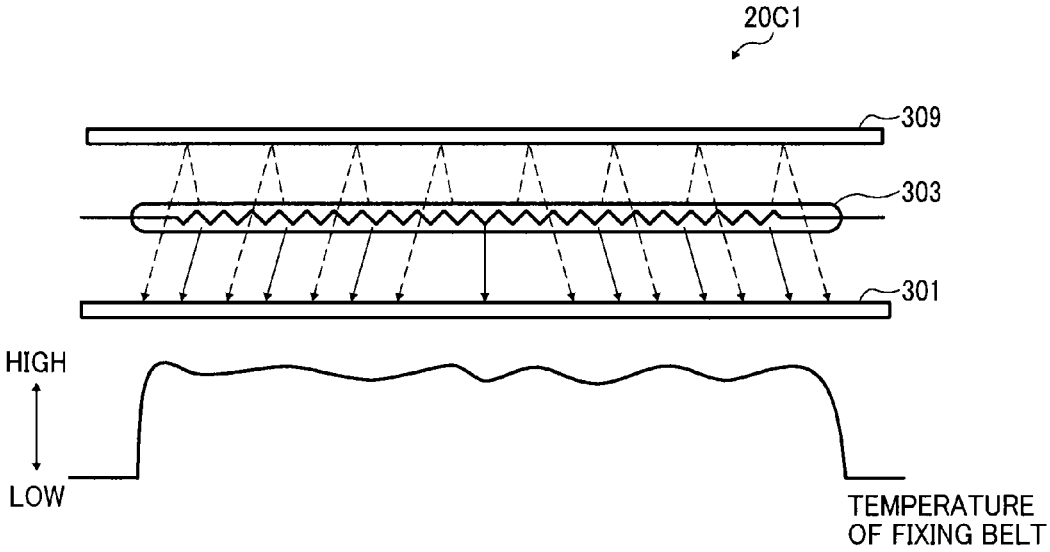
FIG. 9 illustrates a sectional view of the comparative fixing device shown in FIG. 8 taken on line A'-A' of FIG. 8 and temperature distribution of a fixing belt incorporated therein in an axial direction thereof.

FIG. 9 illustrates a sectional view of the comparative fixing device 20C1 taken on line A'-A' of FIG. 8 and temperature distribution of the fixing belt 301 in an axial direction thereof. As shown in FIG. 9, the fixing belt 301 is heated directly by the heater 303 with light, indicated by the solid line, that is emitted from the heater 303 onto the fixing belt 301 and indirectly by the heater 303 with light, indicated by the dotted line, that is emitted from the heater 303 onto the reflector 309 and reflected by the reflector 309 onto the fixing belt 301. Thus, the fixing belt 301 is heated effectively by the heater 303 directly and indirectly.

Since a recording medium passing through the fixing nip N draws heat from the fixing belt 301, a temperature sensor detects the temperature of the fixing belt 301 to maintain the fixing belt 301 at a desired temperature. Conversely, at each lateral end of the fixing belt 301 in the axial direction thereof, the recording medium is not conveyed over the fixing belt 301 and therefore does not draw heat from the fixing belt 301.

Figure 10:
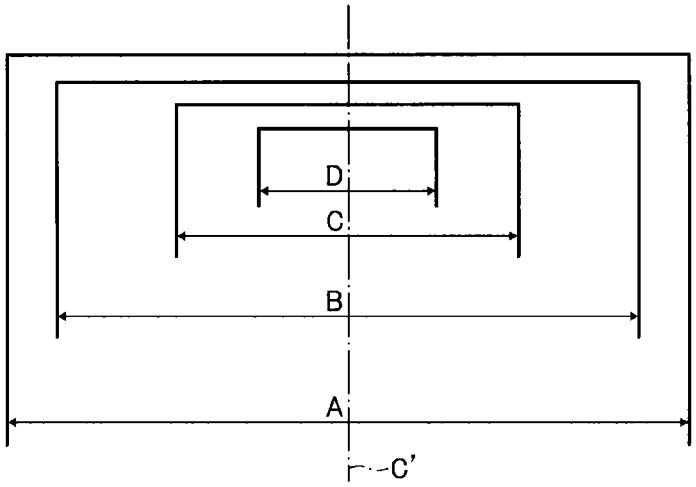
FIG. 10 is a plan view of recording media of various sizes.

With reference to FIG. 10, a detailed description is now given of conveyance of the recording medium over the fixing belt 301.

Figure 11:
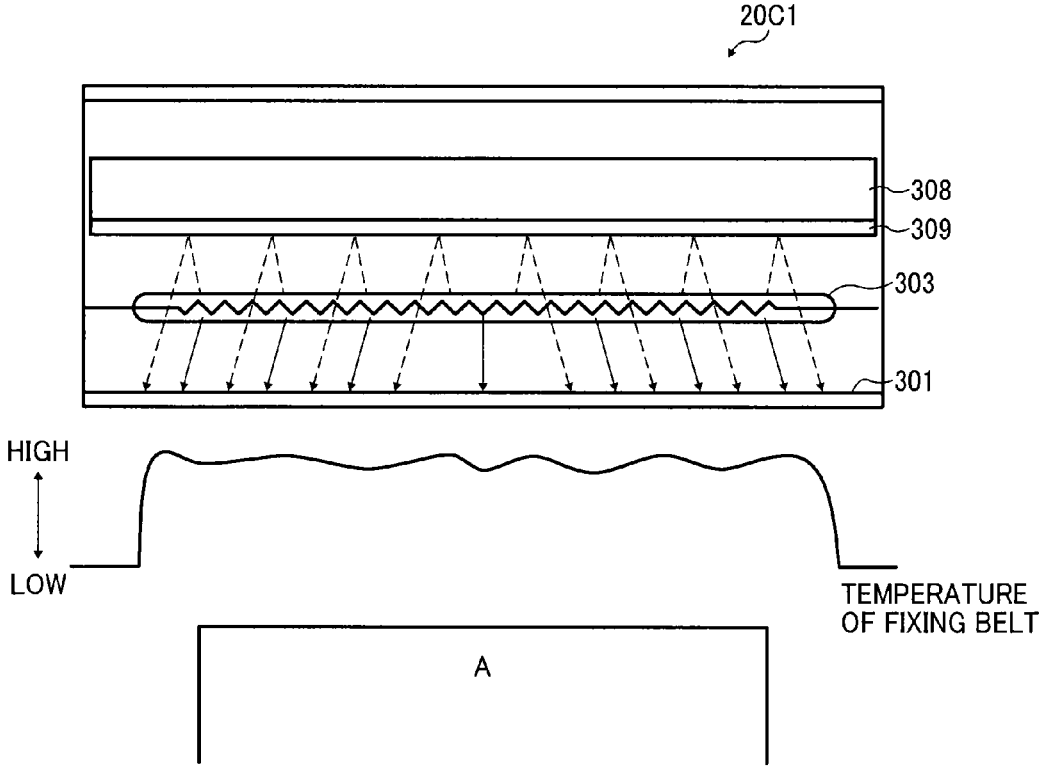
FIG. 11 illustrates a sectional view of the comparative fixing device shown in FIG. 8 and temperature distribution of the fixing belt in the axial direction thereof as a maximum recording medium is conveyed over the fixing belt.

FIG. 10 is a plan view of recording media of various sizes. As shown in FIG. 10, recording media of a plurality of sizes, that is, recording media A to D, are available in the comparative fixing device 20C1. For example, the recording media A to D have four widths in the axial direction of the fixing belt 301 that are different from each other. The recording medium A is a maximum recording medium (e.g., an A3 extension size recording medium) available in the image forming apparatus 1 depicted in FIG. 2. The recording medium B is a large recording medium (e.g., an A3 size recording medium and an A4 size recording medium in landscape orientation) generally used. The recording medium C is a medium recording medium (e.g., an A4 size recording medium in portrait orientation) generally used. The recording medium D is a small recording medium (e.g., a postcard). FIG. 11 illustrates a sectional view of the comparative fixing device 20C1 and temperature distribution of the fixing belt 301 in the axial direction thereof. Similarly to FIG. 9, light from the heater 303 that directly irradiates the fixing belt 301 is indicated by the solid line; light from the heater 303 that is reflected by the reflector 309 is indicated by the dotted line. As shown in FIG. 11, an axial span of the heater 303 in the axial direction of the fixing belt 301 is greater than the width of the maximum recording medium A in the axial direction of the fixing belt 301.

If the recording media A to D are configured to be conveyed over the fixing belt 301 such that a center C' of the recording media A to D in a width direction thereof corresponds to a center of the fixing belt 301 in the axial direction thereof as shown in FIG. 10, the recording media A to D are not conveyed over both axial ends of the fixing belt 301 in the axial direction thereof. Accordingly, the recording media A to D do not draw heat from both axial ends of the fixing belt 301, resulting in overheating of both axial ends of the fixing belt 301. To address this circumstance, the comparative fixing device 20C1 may include a heat shield, disposed opposite each lateral end of the heater 303 in a longitudinal direction thereof parallel to the axial direction of the fixing belt 301, to shield the fixing belt 301 from the heater 303. Accordingly, when the maximum recording medium A is conveyed over the fixing belt 301, both axial ends of the fixing belt 301 are shielded from the heater 303 and therefore do not overheat.

Figure 12:
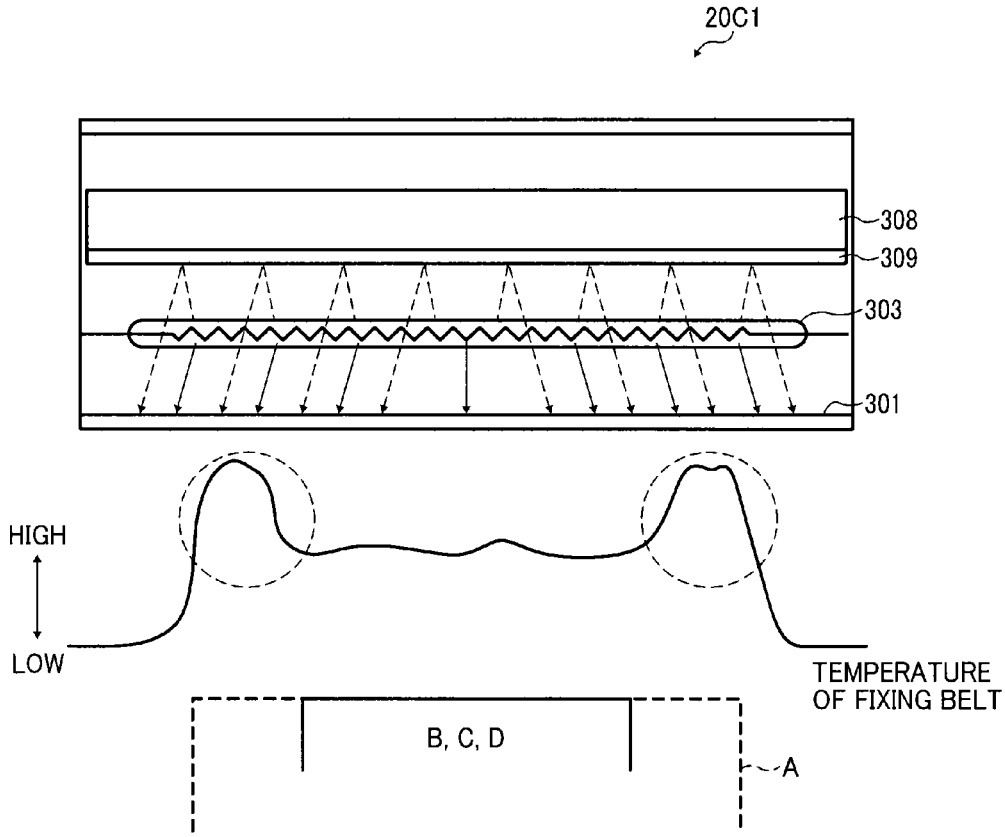
FIG. 12 illustrates a sectional view of the comparative fixing device shown in FIG. 8 and temperature distribution of the fixing belt in the axial direction thereof as a recording medium smaller than the maximum recording medium is conveyed over the fixing belt.

However, when the recording media B to D smaller than the maximum recording medium A are conveyed over the fixing belt 301 as shown in FIG. 12, a greater, axial non-conveyance span where the recording media B to D are not conveyed over the fixing belt 301 is produced at each axial end of the fixing belt 301. FIG. 12 illustrates a sectional view of the comparative fixing device 20C1 and temperature distribution of the fixing belt 301 in the axial direction thereof. Similarly to FIG. 9, light from the heater 303 that directly irradiates the fixing belt 301 is indicated by the solid line; light from the heater 303 that is reflected by the reflector 309 is indicated by the dotted line. Since the recording media B to D do not contact the non-conveyance span of the fixing belt 301, the recording media B to D do not draw heat therefrom, resulting in overheating of the non-conveyance span of the fixing belt 301. Accordingly, the surface temperature of the fixing belt 301 increases excessively at each axial end of the fixing belt 301 as indicated by the dotted circles in FIG. 12.

To address this circumstance, the recording media B to D may be conveyed at a decreased conveyance speed when the fixing belt 301 is heated to a predetermined temperature to prevent overheating of each axial end of the fixing belt 301. However, the decreased conveyance speed may degrade productivity of the comparative fixing device 20C1.

Figure 13:
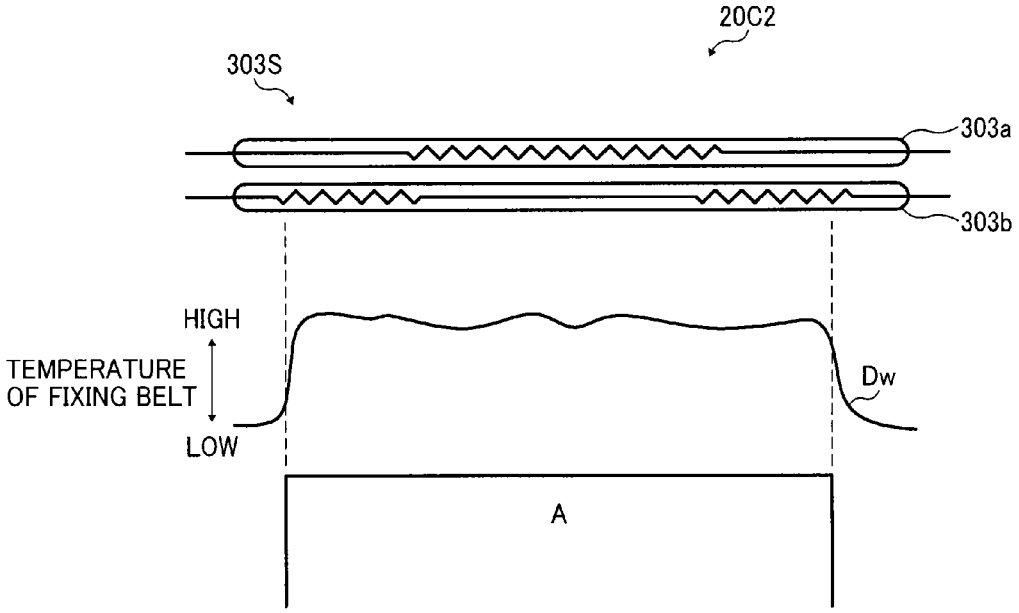
FIG. 13 illustrates a sectional view of another comparative fixing device illustrating a center heater and a lateral end heater incorporated therein that are turned on and temperature distribution of a fixing belt in an axial direction thereof.
Figure 14:
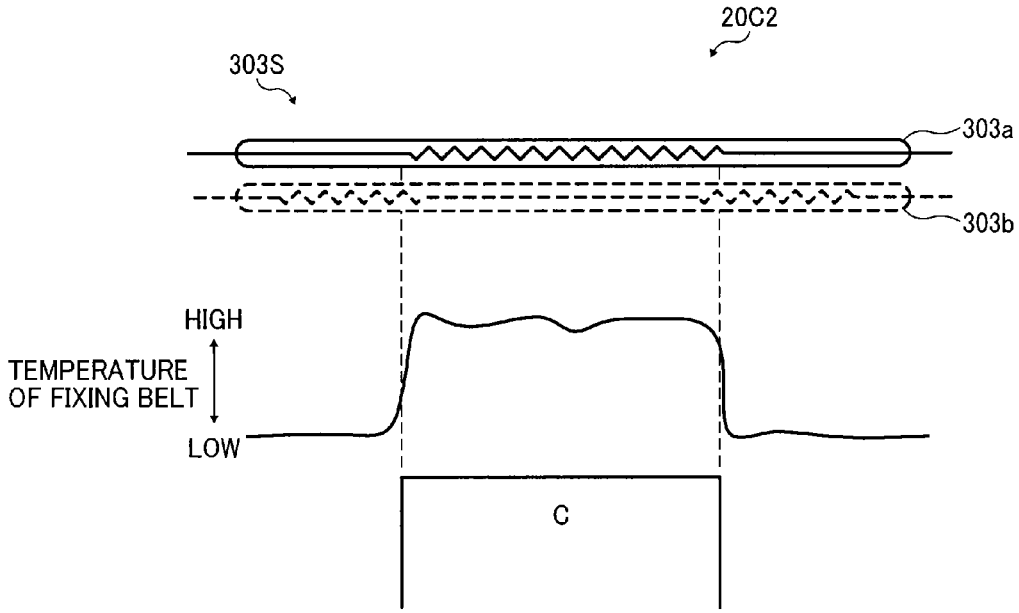
FIG. 14 illustrates a sectional view of the comparative fixing device shown in FIG. 13 illustrating the center heater that is turned on and the lateral end heater that is turned off and temperature distribution of the fixing belt in the axial direction thereof.

To address this circumstance, the comparative fixing device 20C2 may include a heater 303S constructed of two heaters, that is, a center heater **303*a* and a lateral end heater 303*b* as shown in FIGS. 13 and 14. FIG. 13 illustrates a sectional view of the comparative fixing device 20C2 illustrating the center heater 303*a* and the lateral end heater 303*b* that are turned on and temperature distribution of the fixing belt 301 in the axial direction thereof. FIG. 14 illustrates a sectional view of the comparative fixing device 20C2 illustrating the center heater 303*a* that is turned on and the lateral end heater 303*b* that is turned off and temperature distribution of the fixing belt 301 in the axial direction thereof. As shown in FIG. 13, when the greater recording medium A or B is conveyed over the fixing belt 301, the center heater 303*a* and the lateral end heater 303*b* are turned on. Conversely, as shown in FIG. 14, when the smaller recording medium C or D is conveyed over the fixing belt 301, the center heater 303*a* is turned on but the lateral end heater 303*b* is turned off. Thus, the heater 303S prevents overheating of each axial end of the fixing belt 301** while suppressing power consumption.

However, even if the heater 303S is constructed of the center heater **303*a* and the lateral end heater 303*b*, each axial end of the fixing belt 301 may still overheat as the recording medium B or D is conveyed over the fixing belt 301. If the heater 303S is constructed of three or more heaters that correspond to the number of widths of the recording media A to D to address this circumstance, the fixing belt 301** has an increased loop diameter to accommodate the heaters, resulting in increased manufacturing costs.

As shown in FIG. 13, the non-conveyance span of the fixing belt 301 outboard from the recording medium A in the axial direction of the fixing belt 301 is heated by the lateral end heater **303*b* as shown in a temperature curve Dw. Heat indicated by the temperature curve Dw is conducted to resin flanges supporting both axial edges of the fixing belt 301**, degrading the flanges thermally and resulting in breakage and deformation of the flanges.

Figure 15:
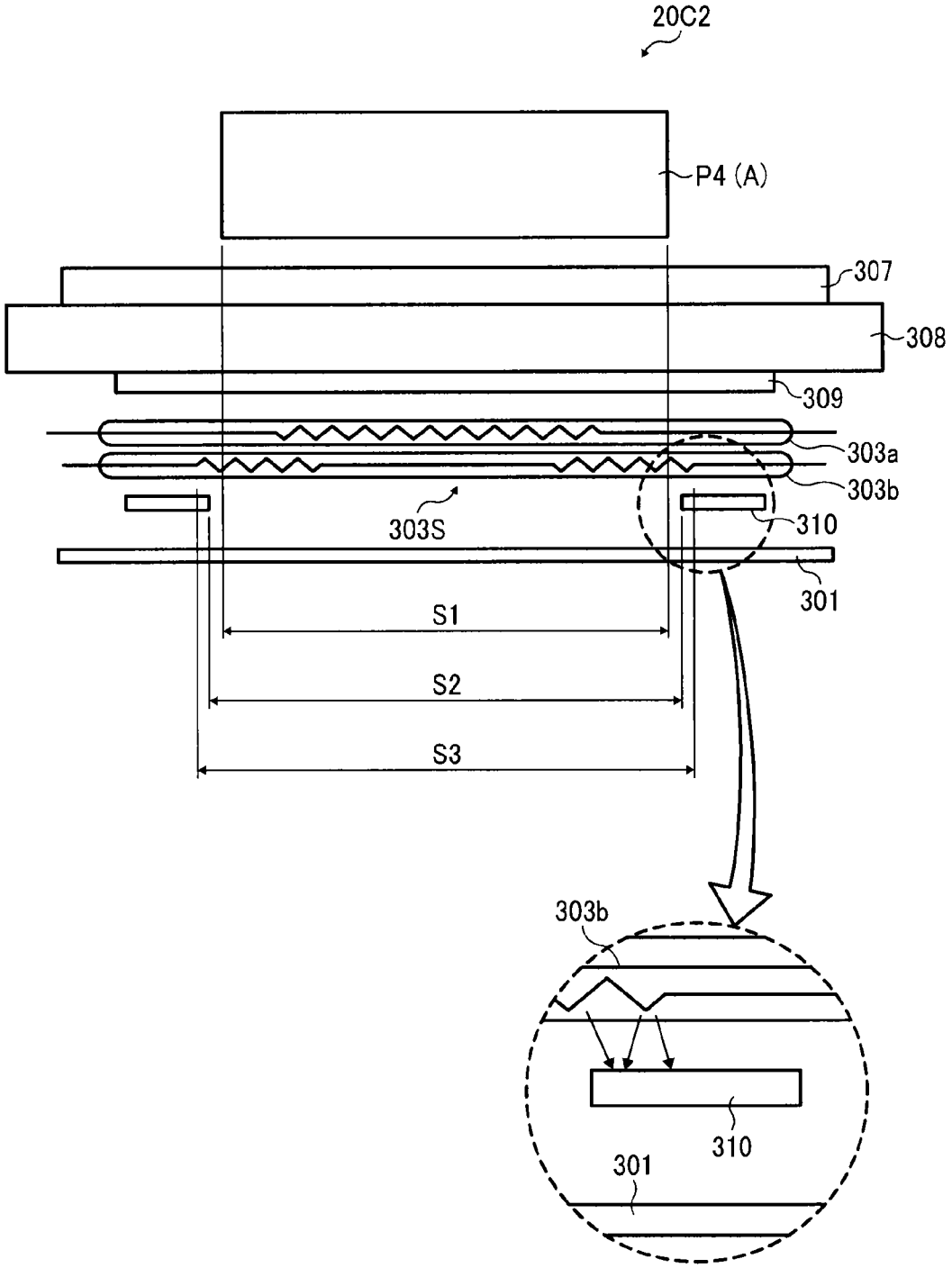
FIG. 15 is a sectional view of the comparative fixing device shown in FIG. 13 illustrating a stationary heat shield incorporated therein.

To address this circumstance, a metallic, stationary heat shield 310 is interposed between the lateral end heater 303*b* and the fixing belt 301 as shown in FIG. 15. FIG. 15 is a sectional view of the comparative fixing device 20C2 illustrating the stationary heat shield 310. In FIG. 15, a span S1 indicates a width of the maximum recording medium A in the axial direction of the fixing belt 301. A span S2 indicates an interval between the two stationary heat shields 310 in the axial direction of the fixing belt 301. A span S3 indicates a heating span of the heater 303S for heating the maximum recording medium A in the axial direction of the fixing belt 301. The stationary heat shield 310 is arcuate to shield each axial end of the fixing belt 301 from the lateral end heater 303*b*. Both circumferential ends of the stationary heat shield 310 in a circumferential direction thereof are fastened to the stay 308 or the reflector 309 with screws or the like.

Thus, the stationary heat shield 310 decreases the area of the non-conveyance span of the fixing belt 301 that is subject to heat indicated by the temperature curve Dw depicted in FIG. 13, suppressing thermal degradation of the flanges that support the fixing belt 301. Additionally, since the flange is situated outboard radially from the stationary heat shield 310, the stationary heat shield 310 shields the flange from the lateral end heater 303*b*, suppressing overheating of the flange.

Figure 16:
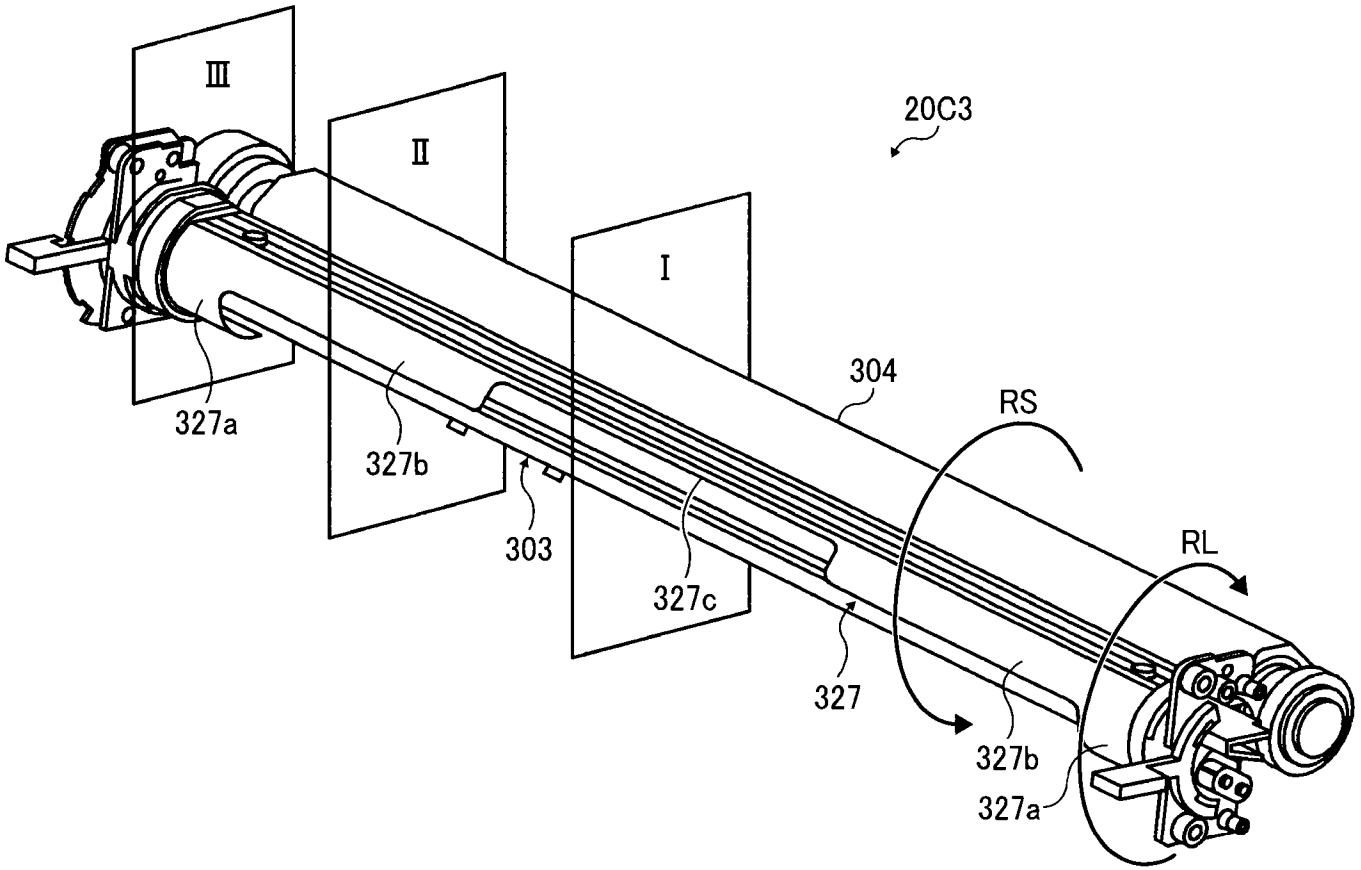
FIG. 16 is a partial perspective view of yet another comparative fixing device.

With reference to FIG. 16, a description is provided of a construction of the comparative fixing device 20C3 incorporating a movable heat shield 327 that rotates in a circumferential direction of the fixing belt 301 to change an axial shield span where the movable heat shield 327 shields the fixing belt 301 from the heater 303.

FIG. 16 is a partial perspective view of the comparative fixing device 20C3. As shown in FIG. 16, the movable heat shield 327 is constructed of two shield portions at each lateral end of the movable heat shield 327 in a longitudinal direction thereof parallel to the axial direction of the fixing belt 301, that is, an outboard shield portion 327*a* and an inboard shield portion 327*b*. The outboard shield portions 327*a* create a greater gap therebetween in the longitudinal direction of the movable heat shield 327. The inboard shield portions 327*b* create a smaller gap therebetween in the longitudinal direction of the movable heat shield 327. A bridge 327*c*, disposed at a center of the movable heat shield 327 in the longitudinal direction thereof, bridges the inboard shield portions 327*b*. The bridge 327*c* shields the fixing belt 301 from the heater 303 throughout the axial span of the fixing belt 301. The movable heat shield 327 rotates in a rotation direction RL to increase an axial heating span of the heater 303 when a greater recording medium is conveyed over the fixing belt 301. Conversely, the movable heat shield 327 rotates in a rotation direction RS to decrease the axial heating span of the heater 303 when a smaller recording medium is conveyed over the fixing belt 301.

With reference to FIGS. 16 to 19, a description is provided of a relation between the size of a recording medium conveyed over the fixing belt 301 and the position of the outboard shield portion 327*a*, the inboard shield portion 327*b*, and the bridge 327*c*.

As shown in FIG. 16, a cross-section I corresponds to a cross-section of the bridge 327*c*. A cross-section II corresponds to a cross-section of the inboard shield portion 327*b*. A cross-section III corresponds to a cross-section of the outboard shield portion 327*a*.

Figure 17:
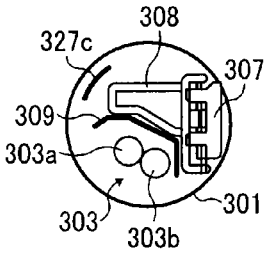
FIG. 17 is a lookup table illustrating the position of an outboard shield portion, an inboard shield portion, and a bridge of a movable heat shield incorporated in the fixing device shown in FIG. 16 that corresponds to the size of a recording medium conveyed over a fixing belt.
Figure 17:
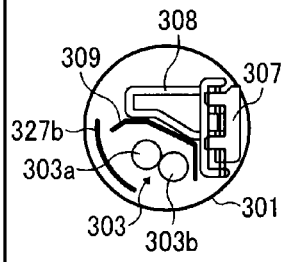
Figure 17:
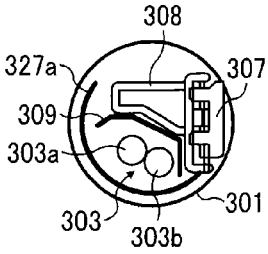
Figure 17:
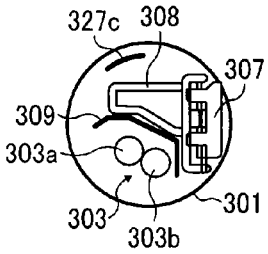
Figure 17:
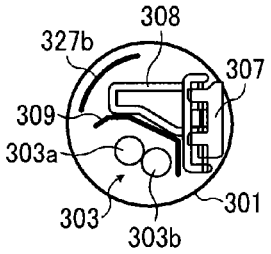
Figure 17:
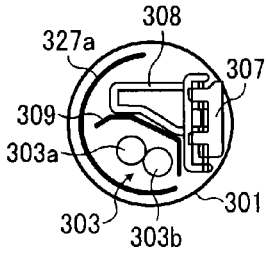
Figure 17:
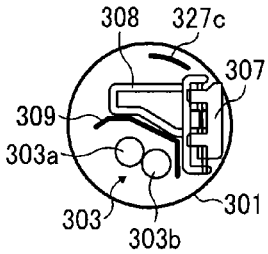
Figure 17:
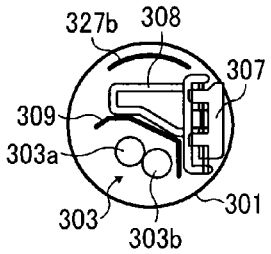
Figure 17:
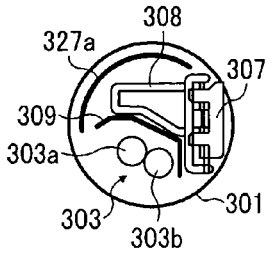

FIG. 17 is a lookup table illustrating the position of the outboard shield portion 327*a*, the inboard shield portion 327*b*, and the bridge 327*c* that corresponds to the size of the recording medium conveyed over the fixing belt 301. FIG. 17 illustrates the position of the bridge 327*c*, the inboard shield portion 327*b*, and the outboard shield portion 327*a* when a small recording medium (e.g., an A5 size recording medium and a postcard), medium and large recording media (e.g., A4 and A3 size recording media), and an extra-large or maximum recording medium (e.g., an A3 extension size recording medium) are conveyed over the fixing belt 301.

Figure 19:
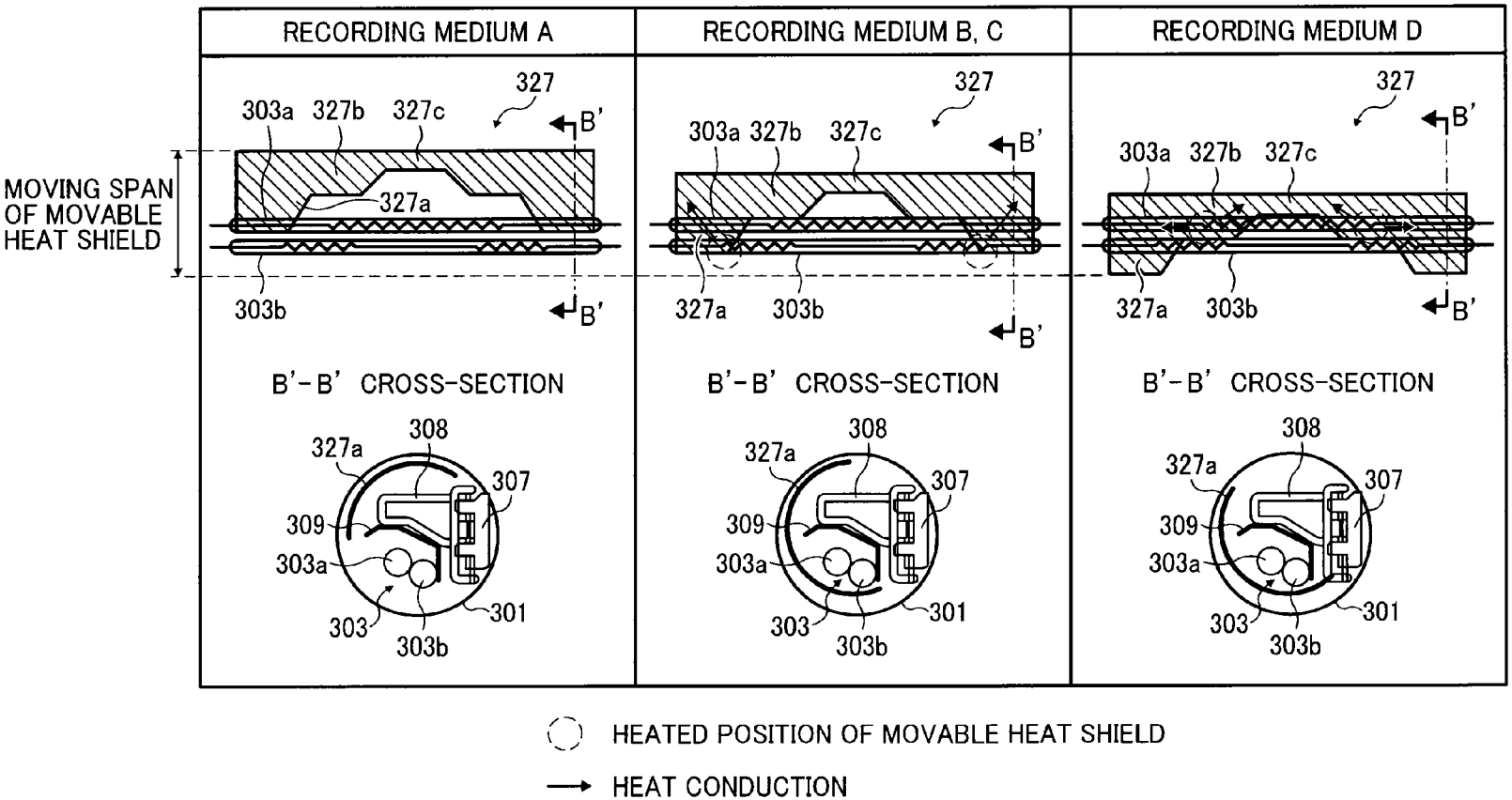
FIG. 19 is a lookup table showing a relation between the size of a recording medium conveyed over the fixing belt and three rotation angled positions of the movable heat shield, illustrating heat conduction through the movable heat shield.

FIG. 18 is a lookup table showing a relation between the size of a recording medium conveyed over the fixing belt 301, turning on of the center heater 303*a* and the lateral end heater 303*b* depicted in FIG. 17, and shielding of the movable heat shield 327. FIG. 19 is a lookup table showing a relation between the size of a recording medium conveyed over the fixing belt 301 and the three, rotation angled positions of the movable heat shield 327, illustrating heat conduction through the movable heat shield 327.

As shown in FIGS. 17 to 19, according to the size of the recording medium, combination of turning on and off of the center heater 303*a* and the lateral end heater 303*b* and the three, rotation angled positions of the movable heat shield 327 is selected, thus preventing overheating of both axial ends of the fixing belt 301. As shown in FIG. 19, as the movable heat shield 327 is disposed opposite the heater 303, the movable heat shield 327 is heated at a heated position indicated by the dotted circle and heat is conducted from the heated position to each lateral end or a center of the movable heat shield 327 in the longitudinal direction thereof, resulting in thermal degradation of the movable heat shield 327. To address this circumstance of the comparative fixing device 20C3, the fixing device 20 according to this exemplary embodiment has a configuration of the movable heat shield 27 and the stationary heat shield 37 described below.

Figure 20:
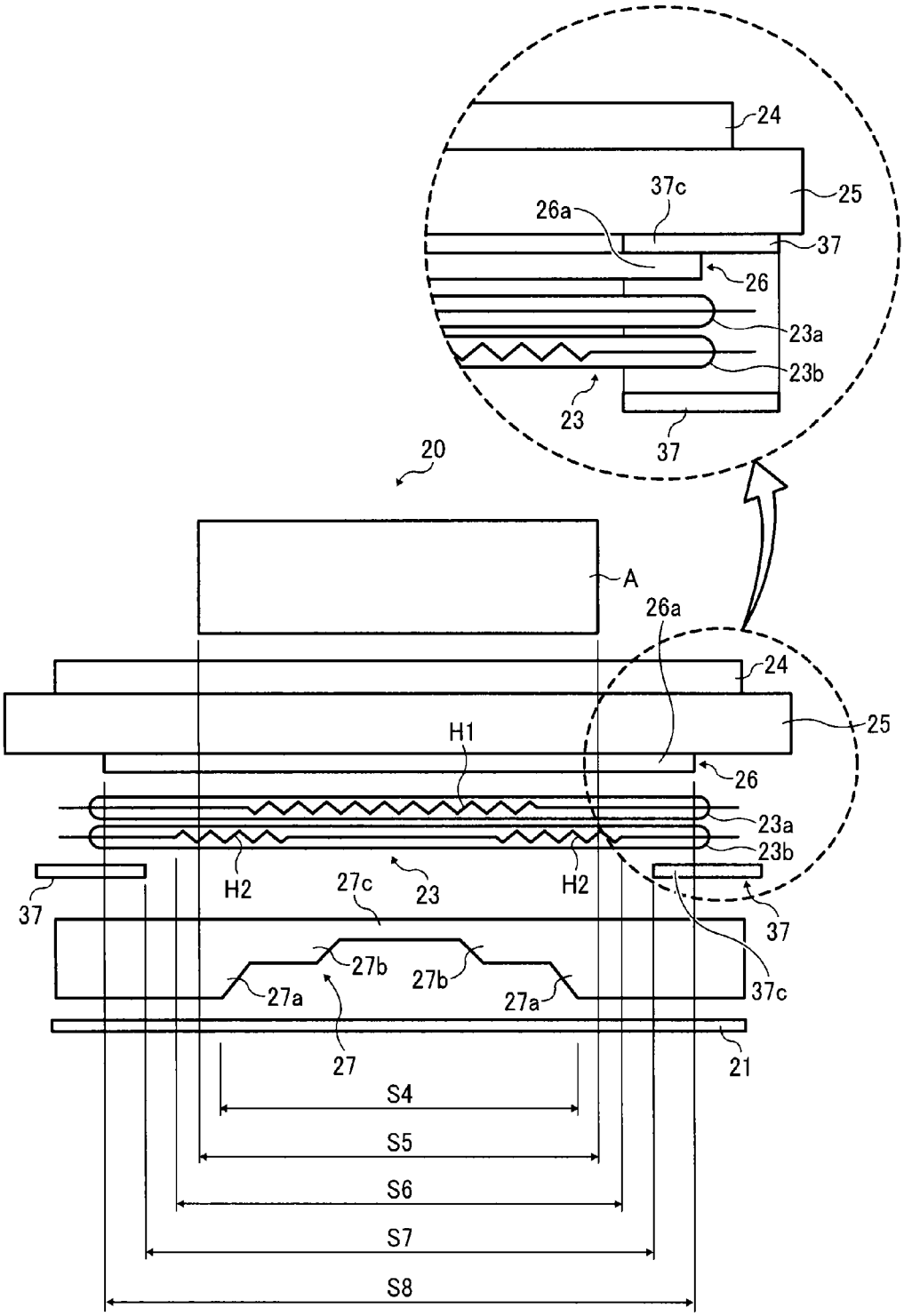
FIG. 20 is a conceptual diagram of the fixing device shown in FIG. 3 illustrating a fixing belt incorporated therein and components situated inside a loop formed by the fixing belt.
Figure 21:
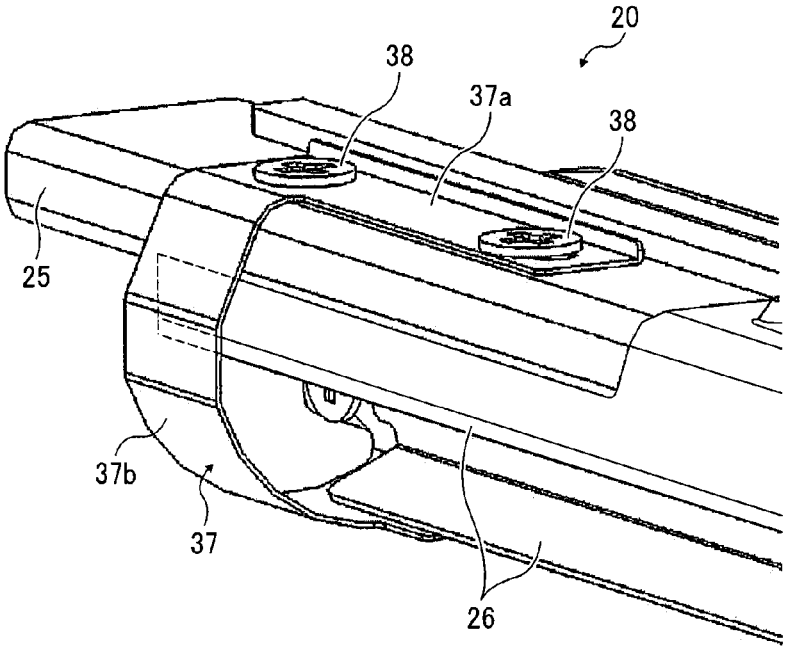
FIG. 21 is a partial perspective view of the fixing device shown in FIG. 20 illustrating a stationary heat shield and a stay incorporated therein.
Figure 22:
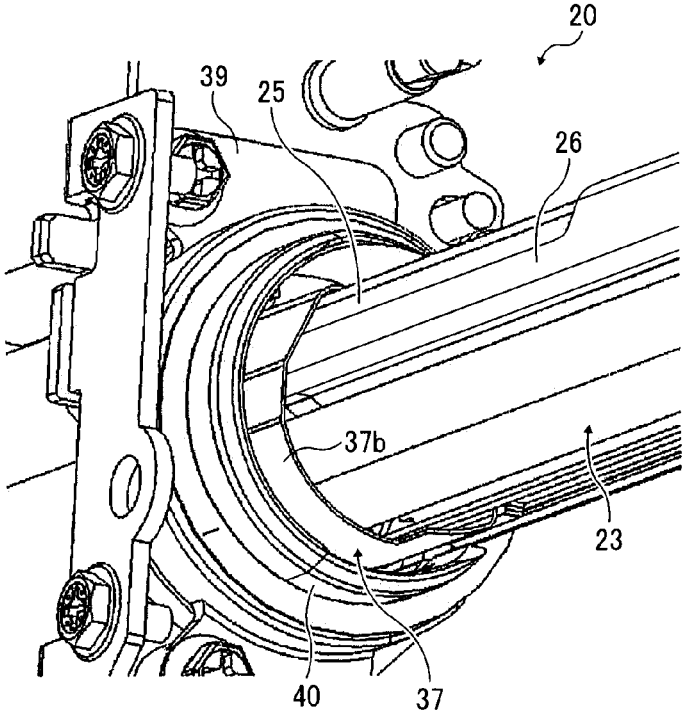
FIG. 22 is a partial perspective view of the fixing device shown in FIG. 20 illustrating a halogen heater pair and the stationary heat shield incorporated therein.

With reference to FIGS. 20 to 22, a description is provided of the configuration of the movable heat shield 27 and the stationary heat shield 37.

FIG. 20 is a conceptual diagram of the fixing device 20 illustrating the fixing belt 21 and the components situated inside the loop formed by the fixing belt 21. As shown in FIG. 20, the fixing device 20 includes the movable heat shield 27 and the stationary heat shield 37. The metal stay 25, constituting a body of the fixing device 20, mounts the nip formation assembly 24 and the reflector 26.

Below the reflector 26 is the halogen heater pair 23 serving as a heater that heats the fixing belt 21. The halogen heater pair 23 is constructed of a center heater 23*a* and a lateral end heater 23*b*. The stationary heat shield 37 is disposed opposite an outer circumferential surface of the halogen heater pair 23 at each lateral end of the halogen heater pair 23 in the longitudinal direction thereof. The movable heat shield 27 is disposed opposite the halogen heater pair 23 via the stationary heat shield 37 and extends along the longitudinal direction of the halogen heater pair 23. The fixing belt 21 serving as a fixing rotary body is disposed opposite the halogen heater pair 23 via the movable heat shield 27 and the stationary heat shield 37.

FIG. 21 is a partial perspective view of the fixing device 20 illustrating the stationary heat shield 37 and the stay 25. As shown in FIG. 21, the stationary heat shield 37 includes a mount 37*a* produced at one end of the stationary heat shield 37 in a circumferential direction thereof. The mount 37*a* is mounted on one end of the stay 25 with screws 38. The stationary heat shield 37 further includes the arcuate shield portion 37*b* extending from an outboard end of the mount 37*a* in the circumferential direction of the stationary heat shield 37. As shown in FIG. 3, the shield portion 37*b*, facing a lower opposed face of the halogen heater pair 23 disposed opposite the fixing belt 21, extends from the upper left of the stay 25 to the lower right of the stay 25 in FIG. 3. An end of the shield portion 37*b* is mounted on the stay 25 with a screw.

FIG. 22 is a partial perspective view of the fixing device 20 illustrating the halogen heater pair 23 and the stationary heat shield 37. As shown in FIG. 22, the resin flange 40 rotatably supporting each axial end of the fixing belt 21 is disposed outboard from the shield portion 37*b* of the stationary heat shield 37 in the axial direction of the fixing belt 21. The flange 40 is molded with a resin side plate 39 located at each lateral end of the fixing device 20.

The shield portion 37*b* of the stationary heat shield 37 projects inboard farther than the flange 40 in the axial direction of the fixing belt 21. That is, when seen from the halogen heater pair 23 disposed opposite an inner circumferential surface of the shield portion 37*b* of the stationary heat shield 37, the flange 40 is behind the shield portion 37*b*. Thus, even when the movable heat shield 27 is situated at the retracted position shown in FIG. 4, the flange 40 situated behind the shield portion 37*b* is shielded from the halogen heater pair 23 by the shield portion 37*b*.

With reference to FIG. 20, a description is provided of a relation between an axial span of the reflector 26 and the halogen heater pair 23, an axial unshield span of the movable heat shield 27 and the stationary heat shield 37, and a width of a recording medium.

In FIG. 20, an axial span S4 defines a maximum axial unshield span of the movable heat shield 27. An axial span S5 defines a width of a maximum recording medium in the axial direction of the fixing belt 21. An axial span S6 defines an axial heating span of the halogen heater pair 23, that is, a maximum axial heating span created by the center heater 23*a* and the lateral end heater 23*b* or an axial span defined by both outboard edges of the lateral end heater 23*b*. An axial span S7 defines an interval between the stationary heat shields 37 in the axial direction of the fixing belt 21. An axial span S8 defines an axial span of the reflector 26. A relation between the axial spans S4 to S8 is shown by a following formula (1).

$$S4<S5<S6<S7\leq S8 \quad (1)$$

Accordingly, as the movable heat shield 27 rotates to a proper rotation angled position according to the size of the recording medium, the movable heat shield 27 shields the fixing belt 21 from the halogen heater pair 23 precisely, preventing overheating of both axial ends of the fixing belt 21 where the recording medium is not conveyed. Each outboard edge of the lateral end heater 23*b* is situated inboard from each inboard edge of the stationary heat shield 37 in the axial direction of the fixing belt 21, suppressing heat conduction from the lateral end heater 23*b* to the stationary heat shield 37 and thereby suppressing overheating of the stationary heat shield 37. Accordingly, heat is not conducted from the stationary heat shield 37 to the flange 40 situated outboard from the stationary heat shield 37 in the axial direction of the fixing belt 21 as shown in FIG. 22, preventing thermal degradation of the flange 40.

As shown in FIG. 20, an inboard end 37*c* of the stationary heat shield 37 in the axial direction of the fixing belt 21 is aligned with or overlaps an outboard end 26*a* of the reflector 26 in the axial direction of the fixing belt 21. Accordingly, as shown in an enlarged view of one lateral end of the components incorporated in the fixing device 20 that is indicated by the dotted circle, the stationary heat shield 37 prevents light from the lateral end heater 23*b* from leaking through a gap between the outboard end 26*a* of the reflector 26 and the halogen heater pair 23 into an outside of the stationary heat shield 37, thus suppressing overheating of each lateral end of the stay 25 in the axial direction of the fixing belt 21.

Although the stay 25 is made of heat resistant metal, the nip formation assembly 24 abutting the stay 25 may be made of resin. Since the resin nip formation assembly 24 is susceptible to thermal deformation, it is preferable that the inboard end 37*c* of the stationary heat shield 37 is aligned with or overlaps the outboard end 26*a* of the reflector 26 to prevent leakage of light from the lateral end heater 23*b* of the halogen heater pair 23 to the stay 25.

Figure 23:
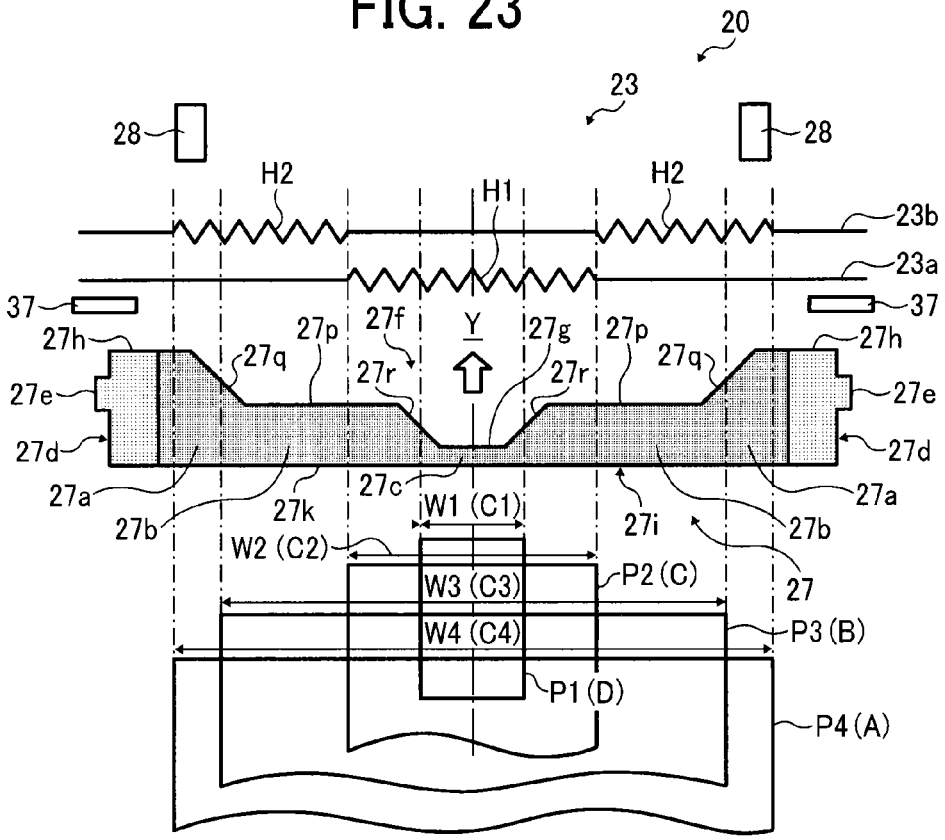
FIG. 23 is a schematic diagram of the halogen heater pair and the movable heat shield incorporated in the fixing device shown in FIG. 20 and recording media of various sizes.
Figure 24:
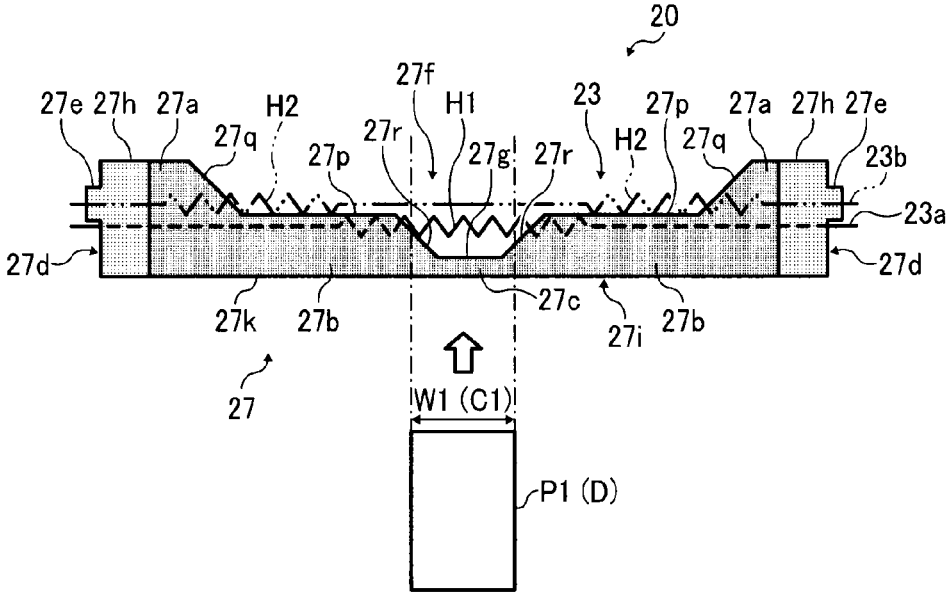
FIG. 24 is a schematic diagram of the movable heat shield shown in FIG. 23 situated at the shield position.

With reference to FIGS. 23 and 24, a description is provided of a relation between the shape of the movable heat shield 27 and the stationary heat shield 37, heat generators H1 and H2 of the halogen heater pair 23, and various sizes of recording media.

FIG. 20 shows the relation between the axial span of the reflector 26 and the halogen heater pair 23, the axial unshield span of the movable heat shield 27 and the stationary heat shield 37, and the width of the recording medium.

With reference to FIGS. 23 and 24, a detailed description is now given of the shape of the movable heat shield 27.

FIG. 23 is a schematic diagram of the halogen heater pair 23, the movable heat shield 27, and recording media of various sizes. FIG. 24 is a schematic diagram of the movable heat shield 27 situated at the shield position. An axial direction of the movable heat shield 27 is parallel to the axial direction of the fixing belt 21. A circumferential direction of the movable heat shield 27 in which the movable heat shield 27 rotates corresponds to the circumferential direction of the fixing belt 21.

As shown in FIG. 23, the movable heat shield 27 includes an outboard, first shield portion 27*a* and an inboard, second shield portion 27*b* that produce two steps at each lateral end of the movable heat shield 27 in the axial direction thereof. For example, the first shield portion 27*a* is disposed outboard from the second shield portion 27*b* in the axial direction of the movable heat shield 27. An axial span of the first shield portion 27*a* is smaller than that of the second shield portion 27*b*. The movable heat shield 27 further includes a bridge 27*c* bridging the second shield portions 27*b* opposing each other in the axial direction of the movable heat shield 27. The first shield portion 27*a* is situated outboard from the second shield portion 27*b* in the axial direction of the movable heat shield 27 contiguously.

The movable heat shield 27 is divided into two sections in view of the material: a center section 27*i* serving as a second section indicated by dark shading and lateral end sections 27*d* serving as first sections indicated by light shading and abutting the center section 27*i*. The center section 27*i* is treated with copper or nickel plating to attain an increased thermal conductivity, thus suppressing overheating of the lateral end sections 27*d*. Since the thermal conductivity of the center section 27*i* is greater than that of the lateral end sections 27*d*, heat moves toward a center of the movable heat shield 27 in the first shield portions 27*a* and the second shield portions 27*b*, suppressing overheating of the lateral end sections 27*d* effectively. Additionally, copper or nickel plating of the center section 27*i* attains an increased gloss that increases reflectance of light, thus suppressing overheating of the movable heat shield 27.

Since the resin flange 40 depicted in FIG. 6 that supports the fixing belt 21 is attached to an circumferential edge of each lateral end section 27*d*, as overheating of each lateral end section 27*d* is suppressed, thermal degradation of the flange 40 is prevented. Alternatively, the center section 27*i* and the lateral end sections 27*d* may be made of different materials having different thermal conductivities, respectively, or the lateral end sections 27*d* may be treated with insulation coating so that the center section 27*i* and the lateral end sections 27*d* have different thermal conductivities, respectively.

As shown in FIG. 23, a downstream edge 27*h* of the first shield portion 27*a* is disposed downstream from a downstream edge 2'7*p* of the second shield portion 27*b* in a shield direction Y in which the movable heat shield 27 moves to the shield position shown in FIG. 24. The downstream edge 27*p* of the second shield portion 27*b* is disposed downstream from a downstream edge 27*g* of the bridge 27*c* in the shield direction Y.

The first shield portions 27*a* have sloped edges 27*q* disposed opposite each other. The second shield portions 27*b* have sloped edges 27*r* disposed opposite each other. The sloped edges 27*q* and 27*r* constitute inboard edges extending substantially in the shield direction Y. The sloped edges 27*q* of the pair of first shield portions 27*a*, the sloped edges 27*r* of the pair of second shield portions 27*b*, and the downstream edge 27*g* of the bridge 27*c* define a recess 27*f*. Upstream edges of the first shield portions 27*a*, the second shield portions 27*b*, and the bridge 27*c* in the shield direction Y constitute an upstream edge 27*k* of the movable heat shield 27, that is, a straight line extending in the axial direction of the movable heat shield 27.

At least four sizes of recording media, including a small recording medium P1 corresponding to the recording medium D depicted in FIG. 10, a medium recording medium P2 corresponding to the recording medium C depicted in FIG. 10, a large recording medium P3 corresponding to the recording medium B depicted in FIG. 10, and an extra-large recording medium P4 corresponding to the recording medium A depicted in FIG. 10, are available in the fixing device 20. For example, the small recording medium P1 includes a postcard having a width of 100 mm. The medium recording medium P2 includes an A4 size recording medium having a width of 210 mm. The large recording medium P3 includes an A3 size recording medium having a width of 297 mm. The extra-large recording medium P4 includes an A3 extension size recording medium having a width of 329 mm. However, the small recording medium P1, the medium recording medium P2, the large recording medium P3, and the extra-large recording medium P4 may include recording media of other sizes.

A width W1 of the small recording medium P1 is smaller than the length of the center heat generator H1 in the longitudinal direction of the halogen heater pair 23 parallel to the axial direction of the movable heat shield 27. The sloped edge 27*r* of the second shield portion 27*b* overlaps a side edge of the small recording medium P1. The sloped edge 27*q* of the first shield portion 27*a* overlaps a side edge of the large recording medium P3. It is to be noted that a description of the relation between the position of recording media other than the small recording medium P1, that is, the medium recording medium P2, the large recording medium P3, and the extra-large recording medium P4, and the position of the center heat generator H1 and the lateral end heat generators H2 of the fixing device 20 is omitted because it is similar to that of the comparative fixing device 20C2 described above with reference to FIG. 13.

As the small recording medium P1 is conveyed through the fixing nip N, the center heat generator H1 is turned on. However, since the center heat generator H1 heats a conveyance span C2 of the fixing belt 21 corresponding to a width W2 of the medium recording medium P2 that is greater than the width W1 of the small recording medium P1, the movable heat shield 27 moves to the shield position shown in FIG. 24. At the shield position shown in FIG. 24, each second shield portion 27*b* shields the fixing belt 21 from the center heat generator H1 in an outboard span in proximity to a side edge of the small recording medium P1 and outboard from a conveyance span C1 corresponding to the width W1 of the small recording medium P1 in the axial direction of the fixing belt 21. Accordingly, the fixing belt 21 does not overheat in the outboard spans where the small recording medium P1 is not conveyed over the fixing belt 21.

As the medium recording medium P2 having the width W2, the large recording medium P3 having a width W3, and the extra-large recording medium P4 having a width W4 are conveyed through the fixing nip N, the halogen heater pair 23 and the movable heat shield 27 are controlled as described above. In this case, each first shield portion 27*a* shields the fixing belt 21 from the halogen heater pair 23 as each second shield portion 27*b* does.

Since the first shield portion 27*a* and the second shield portion 27*b* include the sloped edges 27*q* and 27*r*, respectively, as the rotation angle of the movable heat shield 27 changes, the first shield portions 27*a* and the second shield portions 27*b* shield the fixing belt 21 from the center heat generator H1 and the lateral end heat generators H2 in a variable area.

The first shield portion 27*a* is disposed opposite an outboard end of the lateral end heat generator H2.

For example, the medium recording medium P2 is a letter size recording medium having a width W2 of 215.9 mm or an A4 size recording medium having a width W2 of 210 mm. The large recording medium P3 is a double letter size recording medium having a width W3 of 279.4 mm or an A3 size recording medium having a width W3 of 297 mm. The extra-large recording medium P4 is an A3 extension size recording medium having a width W4 of 329 mm. However, the small recording medium P1, the medium recording medium P2, the large recording medium P3, and the extra-large recording medium P4 may include recording media of other sizes. Additionally, the medium, large, and extra-large sizes mentioned herein are relative terms. Hence, instead of the medium, large, and extra-large sizes, small, medium, and large sizes may be used.

With reference to FIGS. 3 and 4, a description is provided of a fixing operation of the fixing device 20 described above.

As the image forming apparatus 1 depicted in FIG. 2 is powered on, the power supply supplies power to the halogen heater pair 23 and at the same time the driver drives and rotates the pressure roller 22 clockwise in FIG. 3 in the rotation direction R4. Accordingly, the fixing belt 21 rotates counterclockwise in FIG. 3 in the rotation direction R3 in accordance with rotation of the pressure roller 22 by friction between the pressure roller 22 and the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the fixing belt 21 and the pressure roller 22 pressed against the fixing belt 21. The fixing belt 21 heated by the halogen heater pair 23 heats the recording medium P and at the same time the pressure roller 22 pressed against the fixing belt 21, together with the fixing belt 21, exerts pressure on the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge of a separator, the separator separates the recording medium P from the fixing belt 21. Thereafter, the separated recording medium P is discharged by the output roller pair 13 depicted in FIG. 2 onto the outside of the image forming apparatus 1, that is, the output tray 14 where the recording medium P is stocked.

With reference to FIGS. 3, 4, 23, and 24, a description is provided of control of the halogen heater pair 23 and the movable heat shield 27 according to the size of recording media.

As the medium recording medium P2 depicted in FIG. 23 is conveyed over the fixing belt 21 depicted in FIG. 3, the controller turns on the center heat generator H1 to heat the conveyance span C2 of the fixing belt 21 corresponding to the width W2 of the medium recording medium P2. As the extra-large recording medium P4 is conveyed over the fixing belt 21, the controller turns on the lateral end heat generators H2 as well as the center heat generator H1 to heat a conveyance span C4 of the fixing belt 21 corresponding to the width W4 of the extra-large recording medium P4.

However, the halogen heater pair 23 is configured to heat the conveyance span C2 corresponding to the width W2 of the medium recording medium P2 and the conveyance span C4 corresponding to the width W4 of the extra-large recording medium P4. Accordingly, if the center heat generator H1 is turned on as the large recording medium P3 is conveyed over the fixing belt 21, the center heat generator H1 does not heat each outboard span outboard from the conveyance span C2 in the axial direction of the fixing belt 21. Consequently, the large recording medium P3 is not heated throughout the entire width W3 thereof. Conversely, if the lateral end heat generators H2 and the center heat generator H1 are turned on, the lateral end heat generators H2 may heat both outboard spans outboard from a conveyance span C3 in the axial direction of the fixing belt 21 corresponding to the width W3 of the large recording medium P3. If the large recording medium P3 is conveyed over the fixing belt 21 while the lateral end heat generators H2 and the center heat generator H1 are turned on, the lateral end heat generators H2 may heat both outboard spans outboard from the conveyance span C3 in the axial direction of the fixing belt 21 corresponding to the width W3 of the large recording medium P3, resulting in overheating of the fixing belt 21 in the outboard spans outboard from the conveyance span C3 where the large recording medium P3 is not conveyed.

To address this circumstance, as the large recording medium P3 is conveyed over the fixing belt 21, the movable heat shield 27 moves to the shield position as shown in FIG. 24. At the shield position shown in FIG. 24, the first shield portions 27*a* of the movable heat shield 27 shield the fixing belt 21 in a span in proximity to both side edges of the large recording medium P3 and the outboard spans outboard from the conveyance span C3 in the axial direction of the fixing belt 21, thus suppressing overheating of the fixing belt 21 in the outboard non-conveyance spans outboard from the conveyance span C3 where the large recording medium P3 is not conveyed.

When a fixing job is finished or the temperature of the outboard non-conveyance spans of the fixing belt 21 where the large recording medium P3 is not conveyed decreases to a predetermined threshold or lower and therefore the movable heat shield 27 is no longer requested to shield the fixing belt 21, the controller moves the movable heat shield 27 to the retracted position shown in FIG. 4. Thus, the fixing device 20 performs the fixing job precisely by moving the movable heat shield 27 to the shield position shown in FIG. 3 at a proper time without decreasing the rotation speed of the fixing belt 21 and the pressure roller 22 to convey the large recording medium P3. Whether the movable heat shield 27 is at the shield position shown in FIG. 3 or at the retracted position shown in FIG. 4, the bridge 27*c* of the movable heat shield 27 is disposed opposite the indirect heating span IH of the fixing belt 21 as shown in FIGS. 3 and 4. Hence, the bridge 27*c* is not heated by the halogen heater pair 23 directly.

A rotation axis of the movable heat shield 27 is closer to a center of the fixing belt 21 in cross-section. Conversely, an axis of each of the center heater 23*a* and the lateral end heater 23*b* depicted in FIG. 20 of the halogen heater pair 23, that is, an axis of a filament of each of the center heater 23*a* and the lateral end heater 23*b*, is eccentric with respect to the rotation axis of the movable heat shield 27 toward the inner circumferential surface of the fixing belt 21. Accordingly, at the shield position shown in FIG. 3, the movable heat shield 27 is close to the halogen heater pair 23. Conversely, at the retracted position shown in FIG. 4, the movable heat shield 27 is spaced apart from the halogen heater pair 23 farther than at the shield position. Consequently, the movable heat shield 27 at the retracted position is less susceptible to heat radiated from the halogen heater pair 23, suppressing overheating of the movable heat shield 27.

Since the nip formation pad 24 situated inside the loop formed by the fixing belt 21 contacts the fixing belt 21 at the fixing nip N, it is difficult for the movable heat shield 27 to retract toward the fixing nip N. To address this circumstance, the halogen heater pair 23 is situated upstream from the fixing nip N in the recording medium conveyance direction A1. The movable heat shield 27 is movable between the shield position shown in FIG. 3 where the movable heat shield 27 is closer to the fixing nip N in the rotation direction R3 of the fixing belt 21 and the retracted position shown in FIG. 4 where the movable heat shield 27 is spaced apart from the fixing nip N farther than at the shield position.

Accordingly, even when the movable heat shield 27 is at the retracted position shown in FIG. 4, the movable heat shield 27 does not come into contact with the nip formation assembly 24. Additionally, the movable heat shield 27 achieves an increased stroke, attaining flexibility in design with the fixing belt 21 having a decreased loop diameter that decreases the thermal capacity of the fixing belt 21.

Since each first shield portion 27*a* includes the sloped edge 27*q* as shown in FIG. 23, as the rotation angle of the movable heat shield 27 changes, the first shield portion 27*a* shields the fixing belt 21 from the lateral end heat generator H2 in a variable area. Accordingly, as the rotation angle of the movable heat shield 27 changes, the first shield portion 27*a* shields the fixing belt 21 from the lateral end heat generator H2 in the variable area by stepless adjustment at a smallest gap between the lateral end heat generator H2 and the fixing belt 21.

For example, if the number of recording media conveyed through the fixing nip N and a conveyance time for which the recording media are conveyed through the fixing nip N increase, the fixing belt 21 is subject to overheating in the non-conveyance span where the recording media are not conveyed. To address this circumstance, when the number of recording media conveyed through the fixing nip N reaches a predetermined number or when the conveyance time reaches a predetermined conveyance time, the controller moves the movable heat shield 27 in the shield direction Y depicted in FIG. 23 to the shield position shown in FIG. 24 where the movable heat shield 27 shields the fixing belt 21 from the lateral end heat generators H2, precisely suppressing overheating of the fixing belt 21 at both axial ends thereof in the non-conveyance spans where the recording media are not conveyed.

The temperature sensor 28 for detecting the temperature of the fixing belt 21 is disposed opposite an axial span of the fixing belt 21 where the fixing belt 21 is subject to overheating. According to this exemplary embodiment, as shown in FIG. 23, the temperature sensor 28 is disposed opposite each outboard span outboard from the conveyance span C3 corresponding to the width W3 of the large recording medium P3 in the axial direction of the fixing belt 21 because the fixing belt 21 is subject to overheating in the outboard span outboard from the conveyance span C3.

Since the fixing belt 21 is subject to overheating by light radiated from the lateral end heater 23*b* having the lateral end heat generators H2, the temperature sensors 28 are disposed opposite the lateral end heat generators H2, respectively.

The present invention is not limited to the details of the exemplary embodiments described above, and various modifications and improvements are possible. For example, instead of the halogen heater pair 23 incorporating the two heaters, that is, the center heater 23*a* and the lateral end heater 23*b*, a single heater may be used to reduce manufacturing costs. The shape of the movable heat shield 27 is not limited to that shown in FIG. 23. Although the movable heat shield 27 has two steps as shown in FIG. 23, a movable heat shield having three or more steps may be used according to the size of the recording media P and the location of a heater.

As shown in FIG. 4, when the movable heat shield 27 is at the retracted position, the movable heat shield 27 is partially disposed opposite the direct heating span DH of the fixing belt 21. Alternatively, when the movable heat shield 27 is at the retracted position shown in FIG. 4, the movable heat shield 27 may be entirely disposed opposite the indirect heating span IH of the fixing belt 21. Such modification is achieved by changing the shape or the stroke of the movable heat shield 27 or the shape of the stay 25 and the reflector 26. In this case, the movable heat shield 27 at the retracted position is not heated by the halogen heater pair 23 and therefore is immune from thermal deformation or degradation.

A description is provided of advantages of the fixing device 20.

As shown in FIGS. 3 and 4, the fixing device 20 includes the flexible fixing belt 21 serving as a fixing rotary body rotatable in the rotation direction R3; the halogen heater pair 23 serving as a heater to heat the fixing belt 21; the pressure roller 22 serving as an opposed body contacting the outer circumferential surface of the fixing belt 21 to form the fixing nip N therebetween through which a recording medium P bearing a toner image T is conveyed; the nip formation assembly 24 pressing against the pressure roller 22 via the fixing belt 21 to form the fixing nip N; the movable heat shield 27 interposed between the halogen heater pair 23 and the fixing belt 21 to shield the fixing belt 21 from the halogen heater pair 23 in a variable axial span of the fixing belt 21; and the stationary heat shield 37 interposed between the halogen heater pair 23 and the fixing belt 21. As shown in FIG. 23, the stationary heat shield 37 is disposed outboard from a lateral edge of the lateral end heat generator H2 of the halogen heater pair 23 in the axial direction of the fixing belt 21.

Accordingly, the stationary heat shield 37 is subject to heat from the halogen heater pair 23 in a decreased area and therefore immune from overheating. Consequently, a resin component situated outboard from the stationary heat shield 37 in the axial direction of the fixing belt 21 is immune from thermal degradation. Additionally, the movable heat shield 27 shields the fixing belt 21 from the halogen heater pair 23 in the variable axial span of the fixing belt 21, allowing the halogen heater pair 23 to selectively heat the fixing belt 21 in an axial heating span varying depending on the size of the recording medium P and suppressing overheating of an axial end of the fixing belt 21 where the recording medium P is not conveyed.

As shown in FIG. 20, the first shield portion 27*a* and the second shield portion 27*b* of the movable heat shield 27 are disposed at each lateral end of the movable heat shield 27 in the longitudinal direction thereof. The stationary heat shields 37 are disposed opposite the first shield portions 27*a*, respectively. Alternatively, the first shield portion 27*a* and the second shield portion 27*b* may be disposed at one lateral end of the movable heat shield 27 in the longitudinal direction thereof. The stationary heat shield 37 may be disposed opposite the single first shield portion 27*a*. In this case, the recording medium P is conveyed over the fixing belt 21 along one lateral edge of the fixing belt 21 in the axial direction thereof and the first shield portion 27*a*, the second shield portion 27*b*, and the stationary heat shield 37 are disposed in proximity to another lateral edge of the fixing belt 21 in the axial direction thereof.

According to the exemplary embodiments described above, the fixing belt 21 serves as a fixing rotary body. Alternatively, a fixing film or the like may be used as a fixing rotary body. Further, the pressure roller 22 serves as an opposed body. Alternatively, a pressure belt or the like may be used as an opposed body.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation;

a heater disposed opposite and heating the fixing rotary body, the heater including a heat generator to generate heat;

an opposed body contacting the fixing rotary body;

a nip formation assembly pressing against the opposed body via the fixing rotary body to form a fixing nip between the fixing rotary body and the opposed body, the fixing nip through which a recording medium is conveyed;

a movable heat shield movable in a circumferential direction of the fixing rotary body and interposed between the heater and the fixing rotary body to shield the fixing rotary body from the heater in a variable axial span of the fixing rotary body; and a stationary heat shield interposed between the heater and the fixing rotary body to shield the fixing rotary body from the heater, the stationary heat shield disposed outboard from a lateral edge of the heat generator of the heater in an axial direction of the fixing rotary body.

2. The fixing device according to claim 1, further comprising:

a support to support the nip formation assembly; and a reflector mounted on the support to reflect light from the heater toward the fixing rotary body, wherein the stationary heat shield overlaps a lateral end of the reflector in the axial direction of the fixing rotary body.

3. The fixing device according to claim 2, wherein an inboard end of the stationary heat shield in the axial direction of the fixing rotary body is aligned with an outboard end of the reflector in the axial direction of the fixing rotary body.

4. The fixing device according to claim 2, wherein an inboard end of the stationary heat shield in the axial direction of the fixing rotary body overlaps an outboard end of the reflector in the axial direction of the fixing rotary body.

5. The fixing device according to claim 2, wherein the stationary heat shield is mounted on the support.

6. The fixing device according to claim 5, wherein the stationary heat shield includes a mount disposed at one end of the stationary heat shield in a circumferential direction thereof and mounted on the support.

7. The fixing device according to claim 6, wherein the stationary heat shield further includes an arcuate shield portion extending from an outboard end of the mount in the circumferential direction of the stationary heat shield.

8. The fixing device according to claim 1, wherein the movable heat shield includes:

a first section spanning in the axial direction of the fixing rotary body; and a second section abutting the first section and having a thermal conductivity greater than a thermal conductivity of the first section.

9. The fixing device according to claim 8, wherein the second section of the movable heat shield is treated with one of copper plating and nickel plating.

10. The fixing device according to claim 8, further comprising a flange, disposed outboard from the stationary heat shield in the axial direction of the fixing rotary body, to rotatably support each axial end of the fixing rotary body, wherein the stationary heat shield shields the flange from the heater.

11. The fixing device according to claim 10, wherein the flange is attached to the first section of the movable heat shield.

12. The fixing device according to claim 8, wherein the first section of the movable heat shield is disposed opposite each axial end of the fixing rotary body where the recording medium is not conveyed, and wherein the second section of the movable heat shield is disposed opposite a center of the fixing rotary body in the axial direction thereof where the recording medium is conveyed.

13. The fixing device according to claim 1, wherein the stationary heat shield is interposed between the heater and the movable heat shield to shield the movable heat shield from the heater.

14. The fixing device according to claim 1, wherein the movable heat shield includes a plate made of one of metal and ceramic.

15. The fixing device according to claim 1, wherein the fixing rotary body includes a flexible endless belt.

16. The fixing device according to claim 1, wherein the opposed body includes a pressure roller.

17. An image forming apparatus comprising the fixing device according to claim 1.

* * * * *